US011198311B2

(12) United States Patent
Tamaki

(10) Patent No.: US 11,198,311 B2
(45) Date of Patent: Dec. 14, 2021

(54) LIQUID EJECTION DEVICE

(71) Applicant: BROTHER KOGYO KABUSHIKI KAISHA, Nagoya (JP)

(72) Inventor: Shuichi Tamaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/832,911

(22) Filed: Mar. 27, 2020

(65) Prior Publication Data

US 2020/0307257 A1 Oct. 1, 2020

(30) Foreign Application Priority Data

Mar. 28, 2019 (JP) ..... JP2019-063544
Mar. 28, 2019 (JP) ..... JP2019-063557
(Continued)

(51) Int. Cl.
*B41J 2/045* (2006.01)
*B41J 2/135* (2006.01)
(Continued)

(52) U.S. Cl.
CPC ..... *B41J 25/001* (2013.01); *B41J 2/04501* (2013.01); *B41J 2/135* (2013.01);
(Continued)

(58) Field of Classification Search
CPC .... B41J 2/04501; B41J 25/001; B41J 2/2135; B41J 2/16517; B41J 2/21; B41J 3/543; B41J 25/00; B41J 2/165; B41J 2/135
See application file for complete search history.

(56) References Cited

U.S. PATENT DOCUMENTS 7,144,097 B2 * 12/2006 Ando ..... B41J 3/543 347/40
7,591,526 B2 * 9/2009 Mitsuzawa ..... B41J 2/15 347/19
(Continued)

FOREIGN PATENT DOCUMENTS

JP 2005-153382 A 6/2005
JP 2010-241015 A 10/2010
(Continued)

OTHER PUBLICATIONS

New U.S. patent application claiming priority to JP Applications No. 2019-063544, 2019-063557, 2019-063567 and 2019-063573, being filed concurrently with the United States Patent and Trademark Office | Client Ref. 18234BRY21/2018-00412US00).
(Continued)

*Primary Examiner* — Thinh H Nguyen
(74) *Attorney, Agent, or Firm* — K&L Gates LLP

(57) ABSTRACT

On a carriage that is transported in a main scanning direction by a main scanning drive portion heads are disposed so as to be displaced from each other in a sub-scanning direction, and heads are disposed so as to be displaced from each other in the sub-scanning direction. Therefore, even when an ejection failure occurs in nozzles of one of the two heads and in nozzles of one of the two heads ink can be ejected from the other head that ejects the same type of ink in main scanning. Thus, even when the ejection failure occurs in the nozzles, a deterioration in print quality can be suppressed.

9 Claims, 21 Drawing Sheets

(30) Foreign Application Priority Data

Mar. 28, 2019 (JP) ..... JP2019-063567
Mar. 28, 2019 (JP) ..... JP2019-063573

(51) Int. Cl.
*B41J 2/21* (2006.01)
*B41J 3/54* (2006.01)
*B41J 25/00* (2006.01)
*B41J 2/165* (2006.01)

(52) U.S. Cl.
CPC ..... *B41J 2/16517* (2013.01); *B41J 2/21* (2013.01); *B41J 3/543* (2013.01)

(56) References Cited

U.S. PATENT DOCUMENTS 10,173,447 B2 * 1/2019 Zhai ..... B41J 25/001
2005/0206678 A1 9/2005 Nishino
2012/0287188 A1 11/2012 Shimada et al.
2014/0085367 A1 3/2014 Mori et al.

FOREIGN PATENT DOCUMENTS

JP 2011-201322 A 10/2011
JP 2012-236357 A 12/2012
JP 2015-147426 A 8/2015
JP 2015-214130 A 12/2015
JP 2015-221582 A 12/2015
JP 2018-001674 A 1/2018

OTHER PUBLICATIONS

Non-Final Office Action dated Apr. 19, 2021 in related U.S. Appl. No. 16/832,898 Client Ref. 18234BRY21).

* cited by examiner

LIQUID EJECTION DEVICE

CROSS-REFERENCE TO RELATED APPLICATION

This application claims priority to Japanese Patent Application No. 2019-63544 filed Mar. 28, 2019, Japanese Patent Application No. 2019-63557 filed Mar. 28, 2019, Japanese Patent Application No. 2019-63567 filed Mar. 28, 2019, Japanese Patent Application No. 2019-63573 filed Mar. 28, 2019. The contents of the foregoing application are hereby incorporated herein by reference.

BACKGROUND

The present disclosure relates to a liquid ejection device.

An inkjet printer is known that ejects ink used to perform base treatment on a print medium prior to ejection of printing ink. The inkjet printer is provided with a first nozzle array that is aligned along a conveyance direction (a sub-scanning direction) of printing paper and that sprays the printing ink, and a second nozzle array that is disposed in an area on an upstream side of the first nozzle array in the sub-scanning direction and that can spray the printing ink or pre-coating ink. Therefore, after the pre-coating ink is sprayed from the second nozzle array toward the print medium and a base layer is formed on the print medium, the printing ink is sprayed from the first nozzle array onto an area over which the base layer has been formed. Thus, penetration of the printing ink into the print medium is suppressed.

However, in the known inkjet printer, the first nozzle array and the second nozzle array are provided in a single head. Therefore, when an ink ejection failure occurs in one of the nozzles, a problem of the ink ejection failure occurs.

Embodiments of the broad principles derived herein provide a liquid ejection device that can reduce a deterioration in print quality even when an ejection failure of ink from nozzles occurs.

A liquid ejection device of a first aspect of the present disclosure includes: at least two first heads configured to eject a first liquid from nozzles; at least two second heads configured to eject, from nozzles, a second liquid different from the first liquid; and a movement mechanism configured to transport, in a main scanning direction, a carriage on which the at least two first heads and the at least two second heads are mounted, the at least two first heads and the at least two second heads being displaced from each other in a sub-scanning direction, each of the second heads being on the sub-scanning direction side of each of the first heads.

In this case, even when an ejection failure occurs in the nozzles of one of the at least two first heads or in the nozzles of one of the at least two second heads, it is possible to eject the liquid from the nozzles of the other head that ejects the same type of liquid in the main scanning. Thus, even when the ejection failure occurs in the nozzles, a deterioration in print quality can be reduced.

BRIEF DESCRIPTION OF THE DRAWINGS

Embodiments will be described below in detail with reference to the accompanying drawings in which.

DETAILED DESCRIPTION

Figure 1:
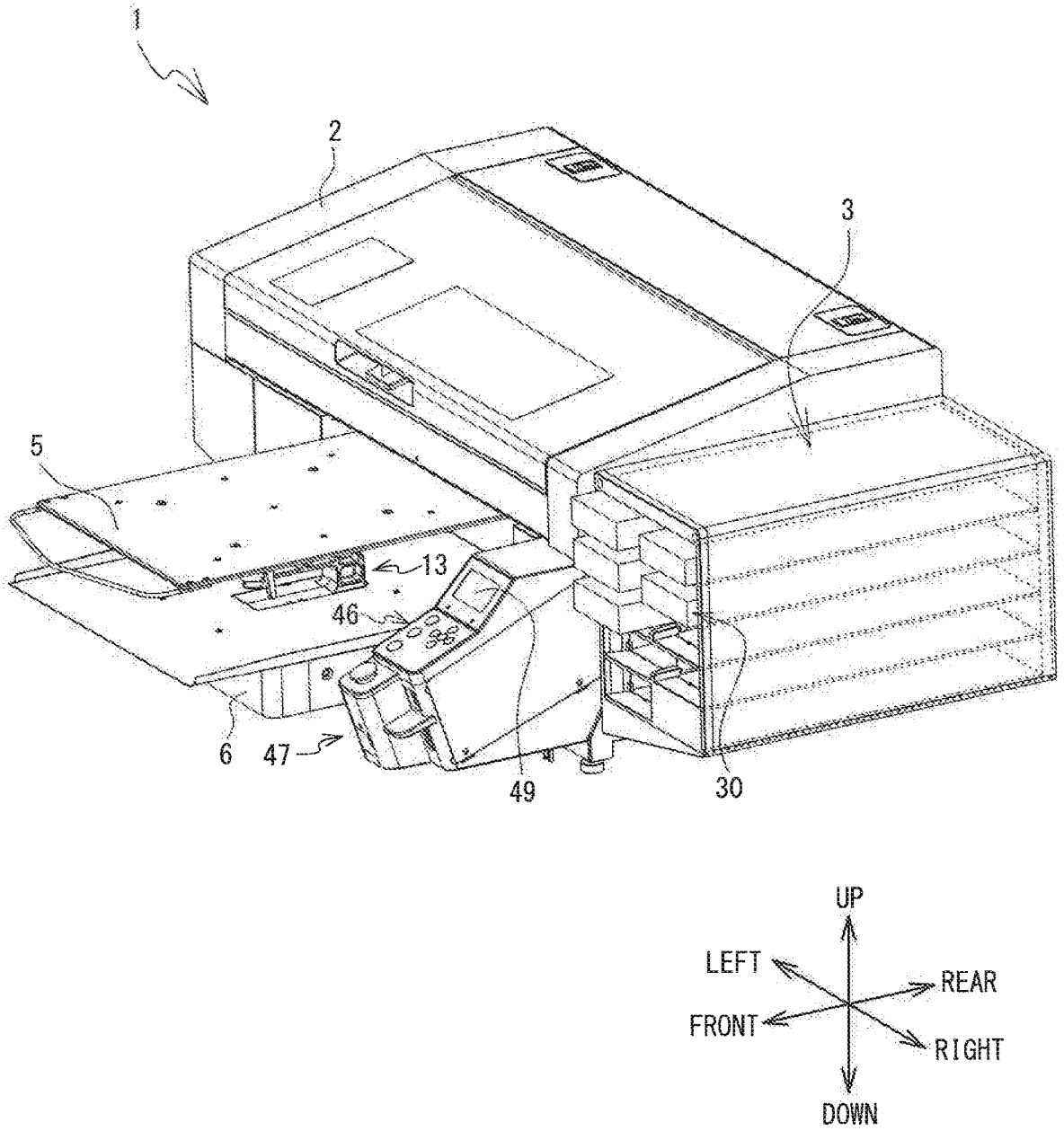
FIG. 1 is a perspective view of a printer 1.

The configuration of a printer 1 of the present disclosure will be explained with reference to FIG. 1. The upper side, the lower side, the lower left side, the upper right side, the lower right side and the upper left side of FIG. 1 respectively correspond to the upper side, the lower side, the front side, the rear side, the right side and the left side of the printer 1.

Mechanical Configuration of Printer 1

The printer 1 is a serial type inkjet printer that performs printing by ejecting a liquid onto a print medium (not shown in the drawings), which is a fabric, such as a T-shirt, or paper etc. For example, the printer 1 prints a color image on the print medium by downwardly ejecting five different types of ink (white (W), black (K), yellow (Y), cyan (C) and magenta (M)) as the liquid. In the following explanation, of the five types of ink, the white color ink is referred to as white ink. When the four colors of ink, i.e., the black, cyan, yellow and magenta inks, are collectively referred to, they are referred to as color ink.

Figure 2:
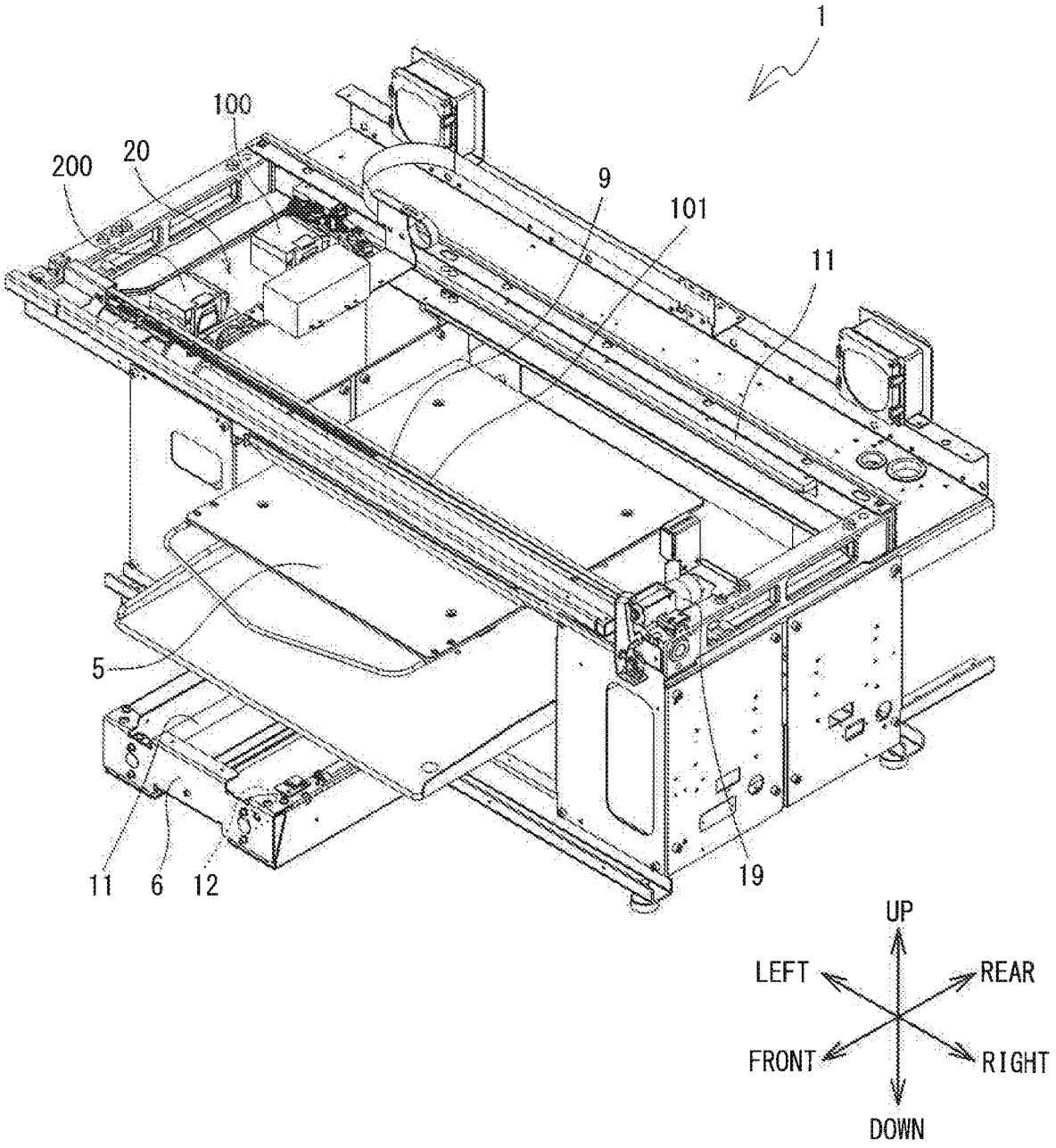
FIG. 2 is a perspective view of the printer 1 when a housing 2 has been removed.

As shown in FIG. 1 and FIG. 2, the printer 1 is provided with a housing 2, a platen drive mechanism 6, a platen 5, a frame body 10, a guide shaft 9, a rail 11, a carriage 20, heads 100 and 200, a drive belt 101, a drive motor 19, maintenance portions 141 and 142 (refer to FIG. 3) provided in a non-printing area 140 to be described later, and the like. The housing 2 has a box shape, and has openings provided respectively in the front surface and the rear surface thereof. An operation portion 47 is provided at a front position on the right side of the housing 2. The operation portion 47 is provided with a display 49 and operation buttons 46.

The platen drive mechanism 6 uses, as a drive source, a motor (not shown in the drawings) provided at a rear end portion thereof, and moves the platen 5 in the front-rear direction of the housing 2 (hereinafter also referred to as a "sub-scanning direction") along a pair of guide rails (not shown in the drawings). The platen 5 has a plate shape. The print medium, which is a fabric such as a T-shirt, is placed on the upper surface of the platen 5.

Figure 18:
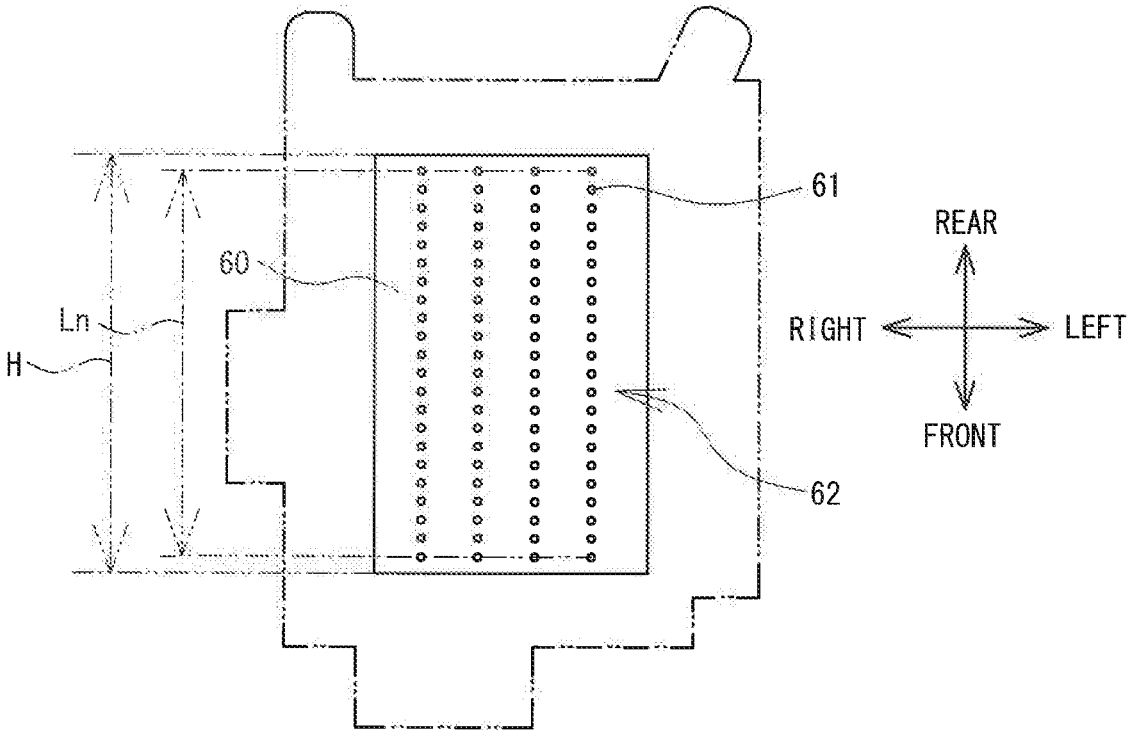
FIG. 18 is a diagram showing a nozzle surface 60 of a head.

The frame body 10 is disposed on an upper portion of the housing 2. The frame body 10 supports the guide shaft 9 and the rail 11 on the inside thereof. The carriage 20 is supported such that it can be conveyed in the left-right direction (hereinafter also referred to as a "main scanning direction") along the guide shaft 9. The heads 100 and 200, and an additional head 300 to be described later are mounted on the carriage 20. The head 100 is positioned to the rear of the head 200. As shown in FIG. 18, a nozzle surface 60 is provided on the bottom surface of each of the heads 100 and 200 and the additional head 300. The nozzle surface 60 is provided with a plurality of nozzle arrays 62 that are provided with a plurality of fine nozzles 61 in the front-rear direction. A nozzle length Ln is the length of the nozzle array 62 in the front-rear direction. The length of the nozzle surface 60 in the sub-scanning direction is a length H. Ink droplets are downwardly ejected from the nozzles 61 as a result of driving of piezoelectric elements. When printing is performed on the print medium when the platen 5 moves from the rear side to the front side, the rear side of the nozzle surface 60 is an upstream side (a side on which the printing is first performed) in the sub-scanning direction. Hereinafter, the head 100 is also referred to as the base printing head 100, and the head 200 is also referred to as the color printing head 200. At a printing start position in each of the head 200, the head 100 and the additional head 300, the nozzles used for printing that are on the rearmost side of each of the heads are positioned on the rearmost side of a printing area. It is sufficient that the respective heads have the same outer shape and the nozzle surface 60 even when the inks ejected therefrom are different. Note that the ink ejected from the base printing head 100 may be the white ink, or may be a discharge printing ink used to decolor the print medium.

The drive belt 101 is stretched along the left-right direction on the inside of the frame body 10. The drive motor 19 can rotate forward and rearward and is coupled to the carriage 20 via the drive belt 101. The printing on the print medium is performed by the inks being ejected from the heads 100, 200 and 300, which reciprocate in the left-right direction as a result of the driving of the drive motor 19, while the platen 5 conveys the print medium in the front-rear direction.

A mounting portion 3 is provided on the right side of the printer 1. A cartridge 30 is connected to the mounting portion 3. The cartridge 30 supplies the liquid stored therein to the head.

Structures of Maintenance Portions

Figure 3:
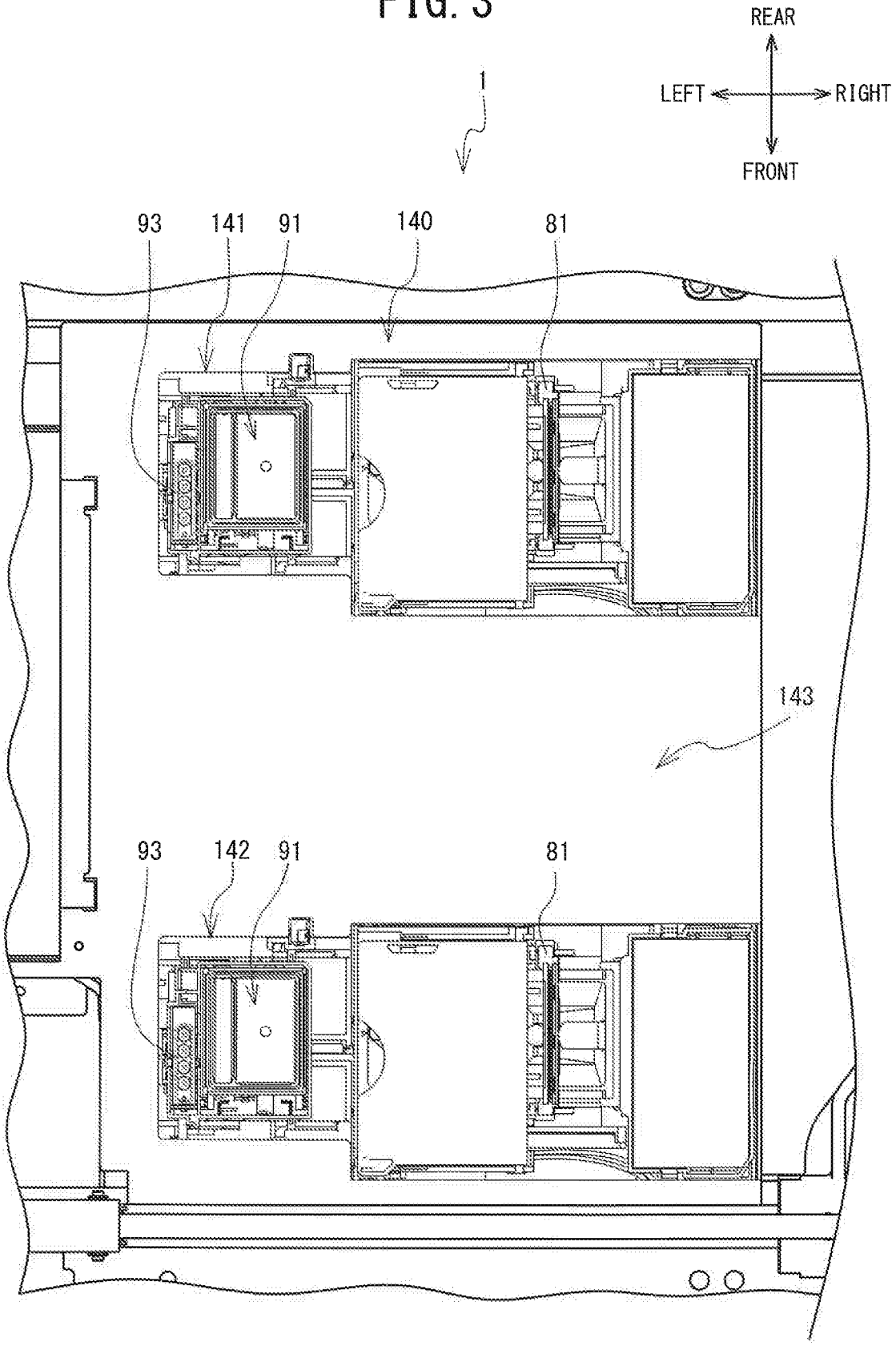
FIG. 3 is a plan view of structures of maintenance portions 141 and 142.

As shown in FIG. 3, in the non-printing area 140, maintenance portions 141 and 142 are respectively provided below movement paths of the heads 100 and 200. Each of the maintenance portions 141 and 142 is provided with a wiper 81, a nozzle cap 91, an exhaust cap 93 and the like. In the maintenance portions 141 and 142, maintenance operations, such as purging, nozzle surface wiping and the like, are performed in order to restore an ink ejection performance of the heads 100 and 200 and to secure print quality of the printer 1. The purging is an operation to discharge the ink including foreign matter, air bubbles and the like from the heads 100 and 200 etc. when each of the heads 100 and 200 is covered by the nozzle cap 91 and the exhaust cap 93. Thus, the ink including the foreign matter, the air bubbles and the like is sucked from the heads 100 and 200, and it is possible to reduce a possibility of an ejection failure occurring in the heads 100 and 200. The nozzle wiping is an operation in which the wiper 81 is used to wipe off the ink etc. remaining on the surface of the nozzle surface 60 of each of the heads 100 and 200. An open space 143 for a maintenance portion that performs maintenance of the additional head 300 is provided between the maintenance portions 141 and 142.

Electrical Configuration of Printer 1

Figure 4:
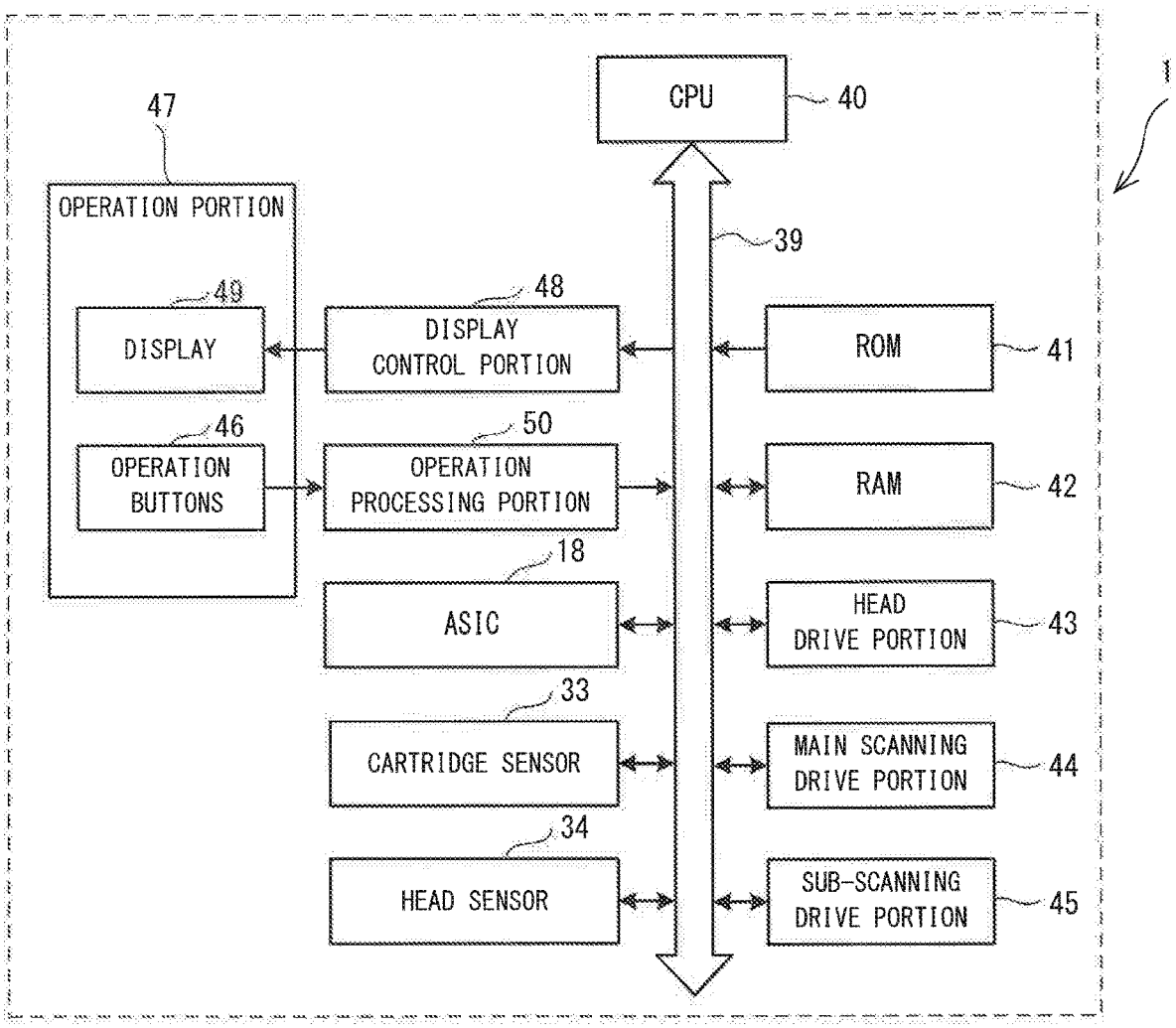
FIG. 4 is a block diagram showing an electrical configuration of the printer 1.

As shown in FIG. 4, the printer 1 is provided with a CPU 40 that controls the printer 1. A ROM 41, a RAM 42, a head drive portion 43, a main scanning drive portion 44, a sub-scanning drive portion 45, an ASIC 18, a display control portion 48, an operation processing portion 50, a cartridge sensor 33 and a head sensor 34 are electrically connected to the CPU 40 via a bus 39.

The ROM 41 stores a control program, initial values and the like that are used by the CPU 40 to control operations of the printer 1. The RAM 42 temporarily stores various data, flags and the like that are used in the control program. The head drive portion 43 is electrically connected to the heads 100 and 200. The head drive portion 43 drives the piezoelectric elements respectively provided in ejection channels of the heads 100 and 200 (refer to FIG. 2), and causes the ink to be ejected from the nozzles.

The main scanning drive portion 44 includes the drive motor 19 (refer to FIG. 2) and causes the carriage 20 to move in the main scanning direction. The sub-scanning drive portion 45 drives the platen drive mechanism 6 (refer to FIG. 1 and FIG. 2) and causes the platen 5 (refer to FIG. 1) to move in the sub-scanning direction. The ASIC 18 controls the head drive portion 43, the main scanning drive portion 44 and the sub-scanning drive portion 45. The cartridge sensor 33 detects attachment/detachment and a type of the cartridge 30. The head sensor 34 detects a type of the head attached to an additional head attachment portion 310. The head sensor 34 is provided on the additional head attachment portion 310, and is configured by a plurality of microswitches, for example. The head sensor 34 detects unevenness of the additional head 300 and detects the type of the additional head 300. The CPU 40 can cause the heads 100, 200 and 300 to eject the respective inks, regardless of whether the carriage 20 moves to the left or to the right. The CPU 40 can cause the heads 100, 200 and 300 to eject the respective inks, regardless of whether the platen 5 moves to the front or to the rear.

Structure of Carriage 20A

The carriage 20A, which is a first working example of the carriage 20, will be explained with reference to FIG. 5. The carriage 20A is a rectangle that is long in the front-rear direction. A head attachment portion 110 is provided on the rear side of the carriage 20A. The base printing head 100 is attached to the head attachment portion 110. An example of the head 100 is a white ink head. An opening (not shown in the drawings) to downwardly expose a nozzle surface (not shown in the drawings) provided on the lower surface of the head 100, and a screw hole (not shown in the drawings) to fix the head 100 are provided in the head attachment portion 110. A head attachment portion 210 is provided on the front side of the carriage 20A. The color printing head 200 is attached to the head attachment portion 210. Examples of the head 200 are heads for yellow, magenta, cyan and black inks. An opening (not shown in the drawings) to downwardly expose a nozzle surface (not shown in the drawings) provided on the lower surface of the head 200, and a screw hole (not shown in the drawings) to fix the head 200 are provided in the head attachment portion 210. Further, the head 100 and the head 200 are disposed so as to be separated from each other in the sub-scanning direction. A distance of separation between the rear end of the nozzle arrays 62 (refer to FIG. 18) of the head 100 and the rear end of the nozzle arrays 62 (refer to FIG. 18) of the head 200 is denoted by La.

Figure 5:
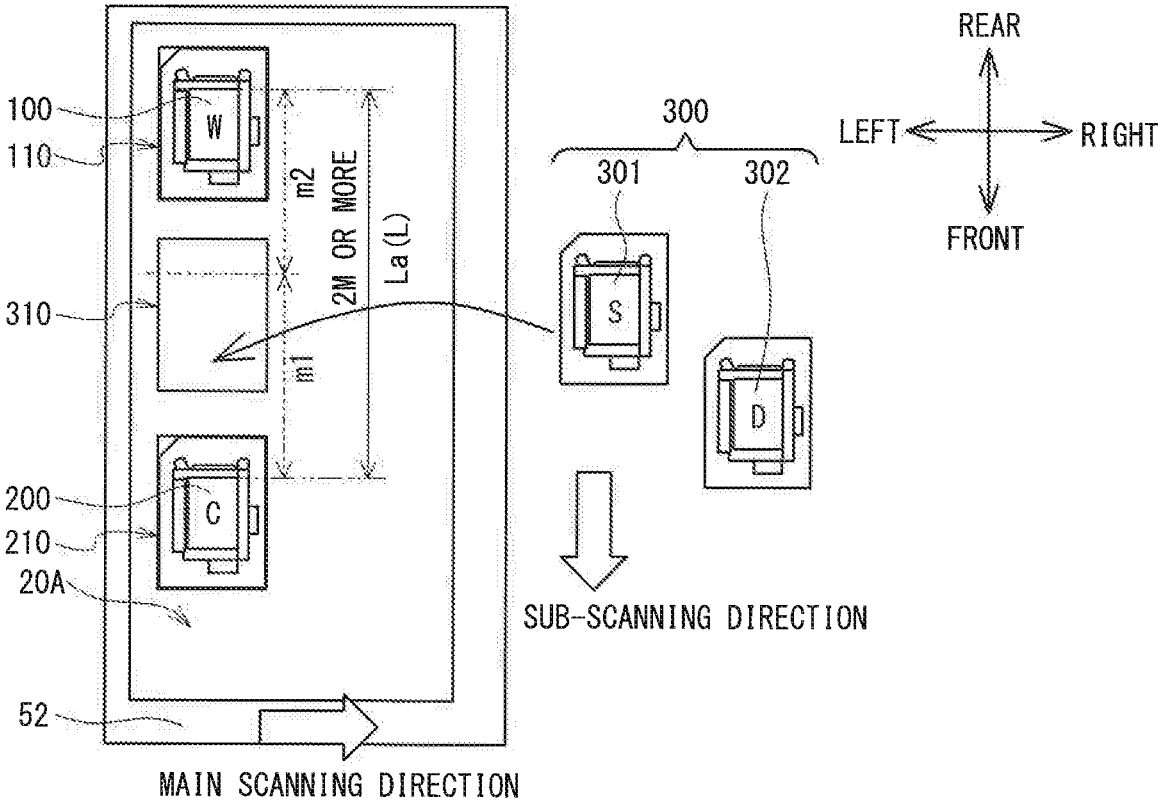
FIG. 5 is a plan view of a carriage 20A.

As shown in FIG. 5, the additional head attachment portion 310 is provided between the head attachment portion 110 and the head attachment portion 210. The additional head 300 is attached to the additional head attachment portion 310. The additional head 300 is, for example, a special ink head 301 that ejects a special ink, which is a specific color ink, or a discharge printing ink head 302 that ejects the discharge printing ink used to decolor the print medium. Examples of the special ink include fluorescent color, gold, silver, metallic color, pastel color and the like, which are colors different from yellow, magenta, cyan, black and white. In each of the drawings, the head for white (which is the base printing head 100) is denoted by "W," and the head for yellow, magenta, cyan and black (which is the color printing head 200) is denoted by "C." Further, the special ink head 301 is denoted by "S," and the discharge printing ink head 302 is denoted by "D."

In FIG. 5, when the single additional head 300 is virtually disposed between the head 100 and the head 200, ml is a distance between the rear end of the nozzle arrays 62 (refer to FIG. 18) of the head 200 and the rear end of the nozzle arrays 62 (refer to FIG. 18) of the additional head 300, and m2 is a distance between the rear end of the nozzle arrays 62 (refer to FIG. 18) of the head 100 and the rear end of the nozzle arrays 62 (refer to FIG. 18) of the additional head 300. It is defined that La =ml+m2. In the explanation below, the distance of separation between the two heads indicates the distance of separation between the rear ends of the nozzle arrays 62 (refer to FIG. 18) of each of the heads. It is assumed that the additional head 300, the head 100 and the head 200 are arranged in a straight line in the sub-scanning direction and that the nozzle arrays thereof are also arranged in a straight line in the sub-scanning direction. In FIG. 5, the distance of separation (hereinafter also referred to as a "bleeding inhibition distance") between the head 100 and the additional head 300, which is provided in order to inhibit the ink from bleeding even when the ink is ejected from the additional head 300 onto the ink ejected from the head 100, is denoted by M. In addition, M also indicates the bleeding inhibition distance between the additional head 300 and the head 200, which is provided in order to inhibit the ink from bleeding even when the ink is ejected from the head 200 onto the ink ejected from the additional head 300. The bleeding inhibition distance M is calculated using the same mathematical expression (Expression 1) as that used to calculate L to be described later. Magnitude correlations between La, m1, m2 and M are m1≥M, m2≥M, and La=m1+m2≥2M. Therefore, in FIG. 5, even if the single additional head 300 is disposed between the head 100 and the head 200, since ml and m2 are equal to or larger than M (m1≥M, m2≥M), the bleeding relating to the ink of the additional head 300 is inhibited.

Structure of Carriage 20B

The carriage 20B, which is a second working example of the carriage 20, will be explained with reference to FIG. 6. The carriage 20B is a rectangle that is long in the front-rear direction. Similarly to the carriage 20A of the first working example, the carriage 20B is provided with a head attachment portion 110A, an additional head attachment portion 310A and a head attachment portion 210A, to the left of the center of the carriage 20B and from the rear side toward the front side of the carriage 20B. A head attachment portion 110B, an additional head attachment portion 310B and a head attachment portion 210B are provided from the rear side toward the front side, to the right of the head attachment portion 110A, the additional head attachment portion 310A and the head attachment portion 210A. The head attachment portion 110B is provided so as to be displaced forward from the head attachment portion 110A by a predetermined length. The additional head attachment portion 310B is also provided so as to be displaced forward from the additional head attachment portion 310A by a predetermined length. The head attachment portion 210B is also provided so as to be displaced forward from the head attachment portion 210A by a predetermined length.

Structures of the attachment portions 110A and 110B, the additional head attachment portions 310A and 310B, and the head attachment portions 210A and 210B are respectively the same as those of the head attachment portion 110, the additional head attachment portion 310 and the head attachment portion 210 of the carriage 20A of the first working example. White ink heads 101A and 101B are attached to the head attachment portions 110A and 110B. Color printing heads 201A and 201B are attached to the head attachment portions 210A and 210B. Additional heads are not attached to the additional head attachment portions 310A and 310B. A distance of separation between the head 101A and the head 201A in the sub-scanning direction is denoted by Lb.

Figure 6:
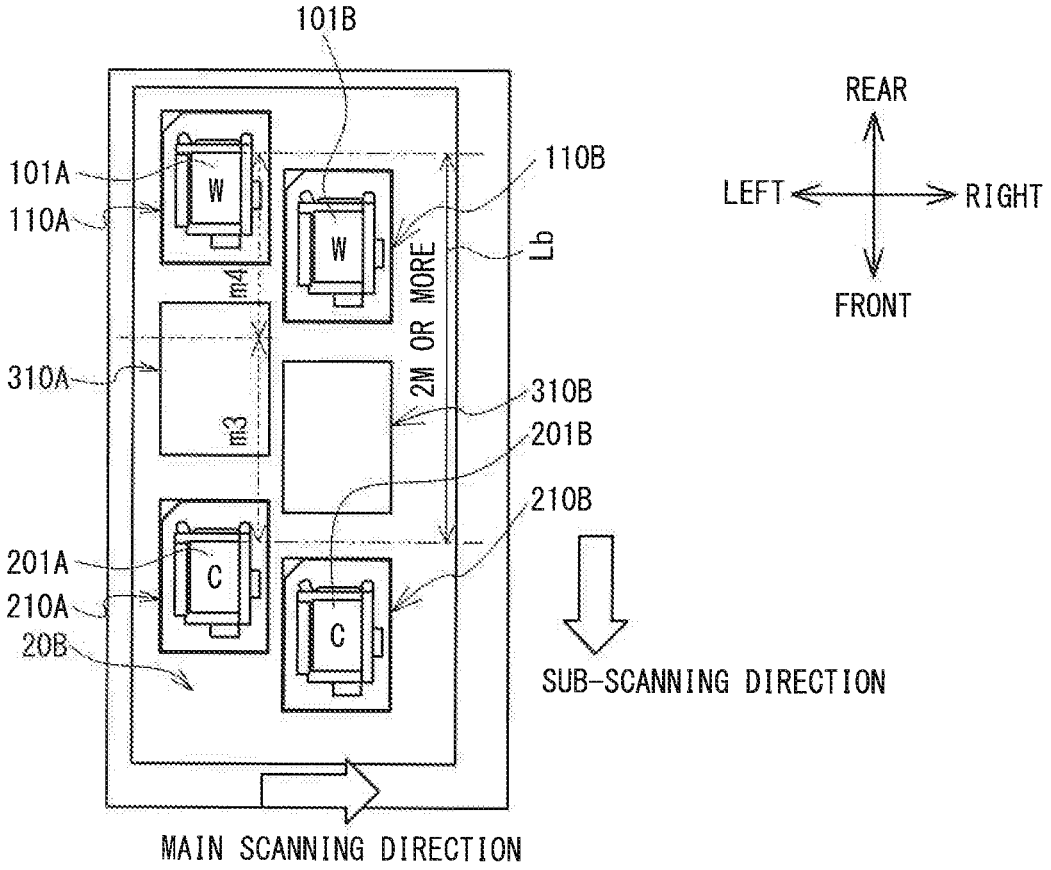
FIG. 6 is a plan view of a carriage 20B.

In FIGS. 6, m3 and m4 are distances estimated in the same manner as in FIG. 5 when the single additional head 300 is virtually disposed between the head 101A and the head 201A. It is defined that Lb=m3+m4. In FIG. 6, it is assumed that the additional head 300, the head 101A and the head 201A are arranged in a straight line in the sub-scanning direction and that the nozzle arrays thereof are also arranged in a straight line in the sub-scanning direction. M is the bleeding inhibition distance of the head 101A or the head 201A with respect to the additional head 300, and is calculated using the same mathematical expression as that used to calculate L to be described later. Magnitude correlations between Lb, m3, m4 and M are m3≥M, m4≥M, and Lb=m3+m4≥2M. Therefore, in FIG. 6, even if the single additional head 300 is disposed between the head 101A and the head 201A, the bleeding relating to the ink of the additional head 300 is inhibited.

Figure 7:
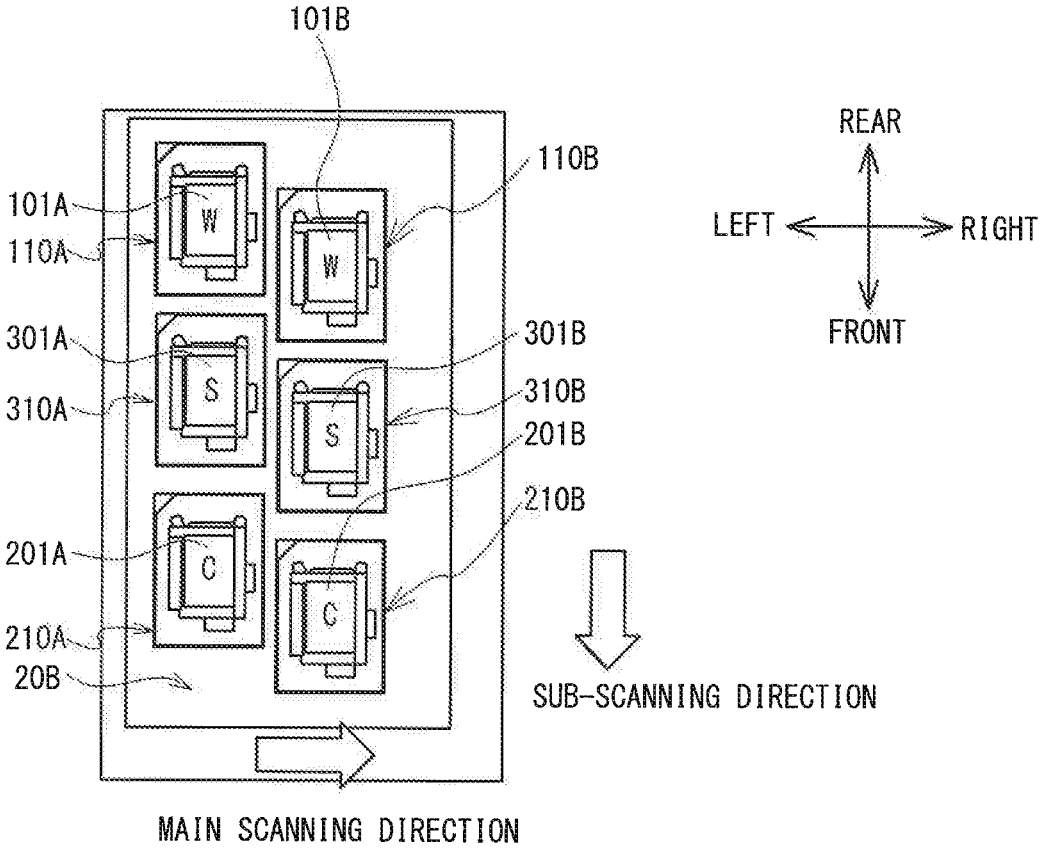
FIG. 7 is a plan view of the carriage 20B.

FIG. 7 shows a state in which special ink heads 301A and 301B are respectively attached to the additional head attachment portions 310A and 310B of the carriage 20B of the second working example shown in FIG. 6. The discharge printing ink head 302 (refer to FIG. 5) may be attached to each of the additional head attachment portions 310A and 310B, or the discharge printing ink head 302 may be attached to the additional head attachment portion 310A and the special ink head 301B may be attached to the additional head attachment portion 310B. The special ink head 301A may be attached to the additional head attachment portion 310A, and the discharge printing ink head 302 (refer to FIG. 5) may be attached to the additional head attachment portion 310B.

Structure of Carriage 20C

The carriage 20C, which is an example of the carriage 20, will be explained with reference to FIG. 8. The carriage 20C is a rectangle that is long in the front-rear direction. A head attachment portion 111A is provided to the left of the center of the carriage 20C and on the rear side of the carriage 20C. An example of a first head that is attached to the head attachment portion 111A is the white ink head 101A or a discharge printing ink head 302A. An opening (not shown in the drawings) to downwardly expose a nozzle surface (not shown in the drawings) provided on the lower surface of the first head, and a screw hole (not shown in the drawings) to fix the first head are provided in the head attachment portion 111A. A head attachment portion 211A is provided on the front side of the carriage 20C. An example of a second head that is attached to the head attachment portion 211A is the color printing head 201A or the special ink head 301A. Further, an opening (not shown in the drawings) to downwardly expose a nozzle surface (not shown in the drawings) provided on the lower surface of the second head, and a screw hole (not shown in the drawings) to fix the second head are provided in the head attachment portion 211A. In this way, the first head and the second head are disposed so as to be separated from each other in the sub-scanning direction that is orthogonal to the main scanning direction. In contrast to the carriage 20B, the additional head attachment portion is not provided between the head attachment portion 111A and the head attachment portion 211A.

A head attachment portion 111B and a head attachment portion 211B are provided on the carriage 20C from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. Structures of the head attachment portion 111B and the head attachment portion 211B are respectively the same as those of the head attachment portion 111A and the head attachment portion 211A. An example of the first head that is attached to the head attachment portion 111B is the white ink head 101B or a discharge printing ink head 302B. An example of the second head that is attached to the head attachment portion 211B is the color printing head 201B or the special ink head 301B. In FIG. 8, the white ink heads 101A and 101B are attached to the head attachment portions 111A and 111B of the carriage 20C. The color printing heads 201A and 201B are attached to the head attachment portions 211A and 211B.

Figure 20:
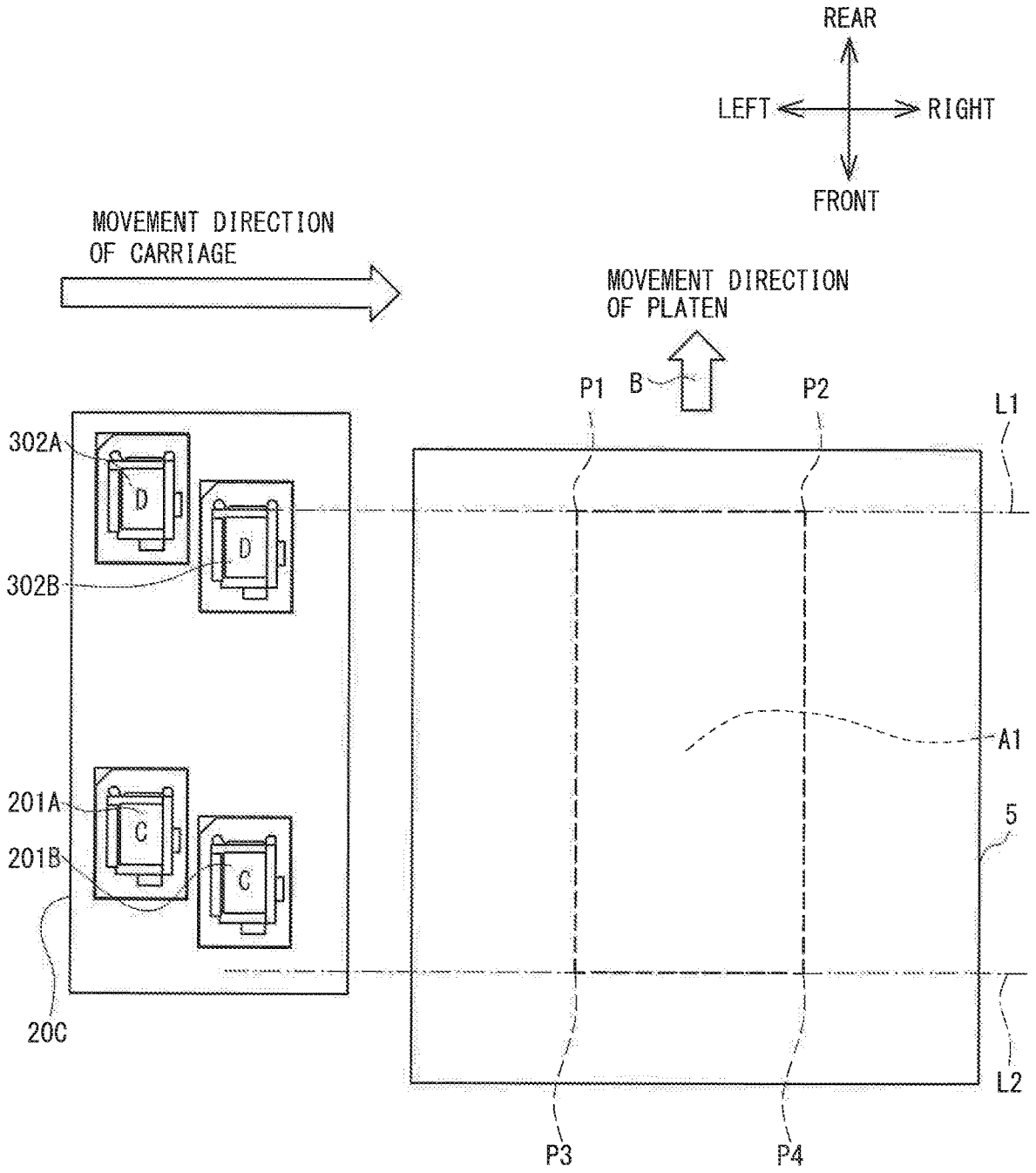
FIG. 20 is a diagram showing a positional relationship of the platen 5 and the carriage 20C that moves toward the platen 5 located at a discharge printing start position.

That is, on the carriage 20C that is transported in the main scanning direction by the main scanning drive portion 44, the two heads 101A and 101B or the two heads 302A and 302B are disposed so as to be displaced from each other in the sub-scanning direction, and the two heads 201A and 201B are disposed so as to be displaced from each other in the sub-scanning direction. Further, the two heads 101A and 101B and the two heads 201A and 201B are mounted on the carriage 20C such that the distance by which the two heads 101A and 101B are displaced from each other in the sub-scanning direction is the same as the distance by which the two heads 201A and 201B are displaced from each other in the sub-scanning direction. Further, the two heads 302A and 302B and the two heads 201A and 201B are mounted on the carriage 20C such that the distance by which the two heads 302A and 302B are displaced from each other in the sub-scanning direction is the same as the distance by which the two heads 201A and 201B are displaced from each other in the sub-scanning direction. Further, as shown in FIG. 8, the two heads 101A and 101B and the two heads 201A and 201B are mounted on the carriage 20C such that the distance between the head 101A and the head 201A is the same as the distance between the head 101B and the head 201B in the sub-scanning direction. In addition, as shown in FIG. 20, the two heads 302A and 302B and the two heads 201A and 201B are mounted on the carriage 20C such that the distance between the head 302A and the head 201A is the same as the distance between the head 302B and the head 201B in the sub-scanning direction.

Note that the length of an open section 320 in the sub-scanning direction is longer than the length in the sub-scanning direction of the head that is attached to the head attachment portion 111A or the head attachment portion 211A. Therefore, the head attachment portion 111A and the head attachment portion 211A are separated from each other in the sub-scanning direction by more than the length in the sub-scanning direction of the head that is attached to the head attachment portion 111A or the head attachment portion 211A. This also applies to the head attachment portion 111B and the head attachment portion 211B. Therefore, the two heads 101A and 101B and the two heads 201A and 201B are mounted on the carriage 20C such that the distance between the head 101A and the head 201A and the distance between the head 101B and the head 201B in the sub-scanning direction are each longer than the length of each of the head 101A and the head 101B in the sub-scanning direction. This relationship also applies to the distance between the head 302A and the head 201A of the carriage 20C shown in FIG. FIG. 20, and the distance between the head 302B and the head 201B.

The white ink heads 101A and 101B may respectively be attached to the head attachment portions 111A and 111B of the carriage 20C, the color printing head 201A may be attached to the head attachment portion 211A, and the special ink head 301B may be attached to the second head attachment portion 211B. The discharge printing ink head 302A may be attached to the head attachment portion 111A, the white ink head 101B may be attached to the head attachment portion 111B, and the color printing heads 201A and 201B may respectively be attached to the head attachment portions 211A and 211B. The discharge printing ink heads 302A and 302B may respectively be attached to the head attachment portions 111A and 111B, and the color printing heads 201A and 201B may respectively be attached to the head attachment portions 211A and 211B.

Figure 8:
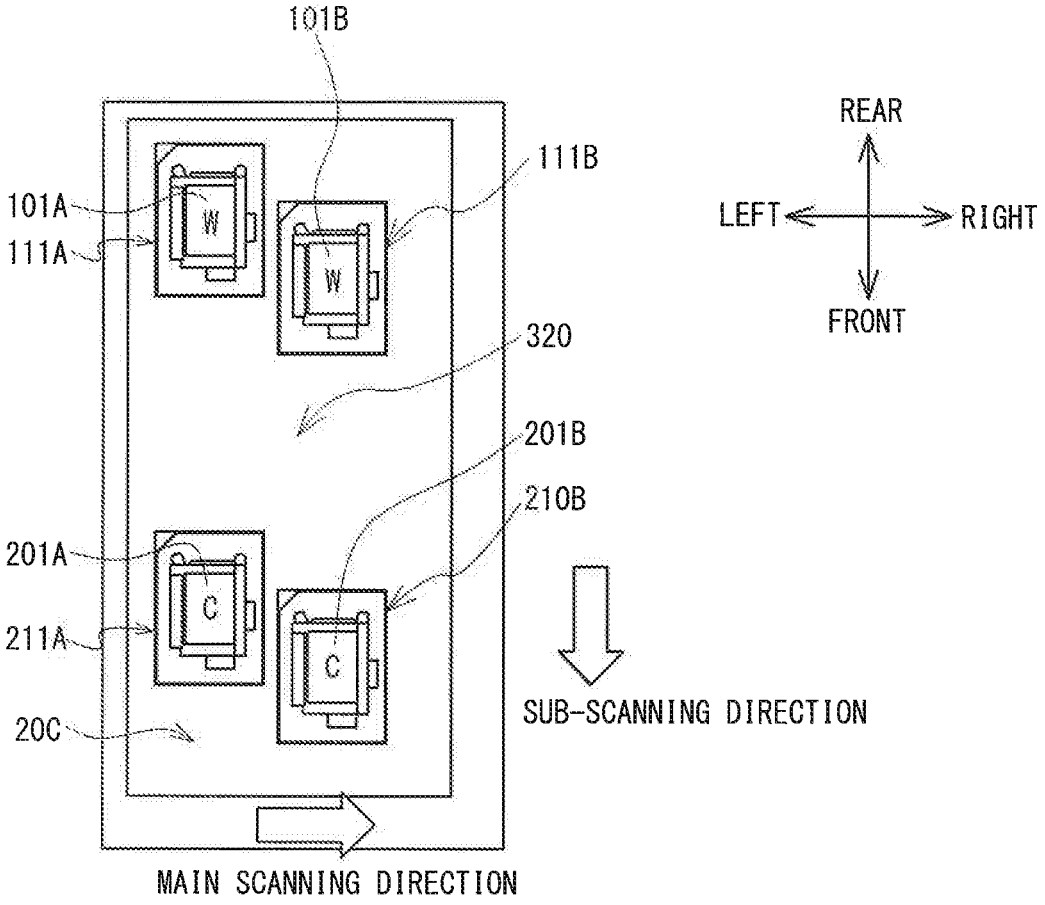
FIG. 8 is a plan view of a carriage 20C.

Further, as shown in FIG. 8, in the printer 1, the head 101A and the head 201A may be disposed on the carriage 20C such that the head 101A and the head 201A are separated from each other in the sub-scanning direction by more than the length in the sub-scanning direction of one of the head 101A and the head 201A for which the length Ln (refer to FIG. 18) of the nozzle array in the sub-scanning direction is shorter. Further, the head 101B and the head 201B may be disposed on the carriage 20C such that the head 101B and the head 201B are separated from each other in the sub-scanning direction by more than the length in the sub-scanning direction of one of the head 101B and the head 201B for which the length Ln (refer to FIG. 18) of the nozzle array in the sub-scanning direction is shorter. In addition, the head 302A and 302B and the head 201A and 201B of the carriage 20C shown FIG. 20 may have the same relationship as that described above.

Structure of Carriage 20D

The carriage 20D, which is a fourth working example of the carriage 20, will be explained with reference to FIG. 9. The carriage 20D is a rectangle that is long in the front-rear direction. The head attachment portion 111A is provided on the leftmost side of and on the rear side of the carriage 20D. An example of the first head that is attached to the head attachment portion 111A is the white ink head 101A. The opening (not shown in the drawings) to downwardly expose the nozzle surface (not shown in the drawings) provided on the lower surface of the first head, and the screw hole (not shown in the drawings) to fix the first head are provided in the head attachment portion 111A. The head attachment portion 211A is provided to the front of the head attachment portion 111A. An example of the second head that is attached to the head attachment portion 211A is the color printing head 201A. The opening (not shown in the drawings) to downwardly expose the nozzle surface (not shown in the drawings) provided on the lower surface of the second head, and the screw hole (not shown in the drawings) to fix the second head are provided in the head attachment portion 211A. The first head and the second head are disposed so as to be separated from each other in the sub-scanning direction that is orthogonal to the main scanning direction. The additional head attachment portion is not provided between the head attachment portion 111A and the head attachment portion 211A.

Figure 9:
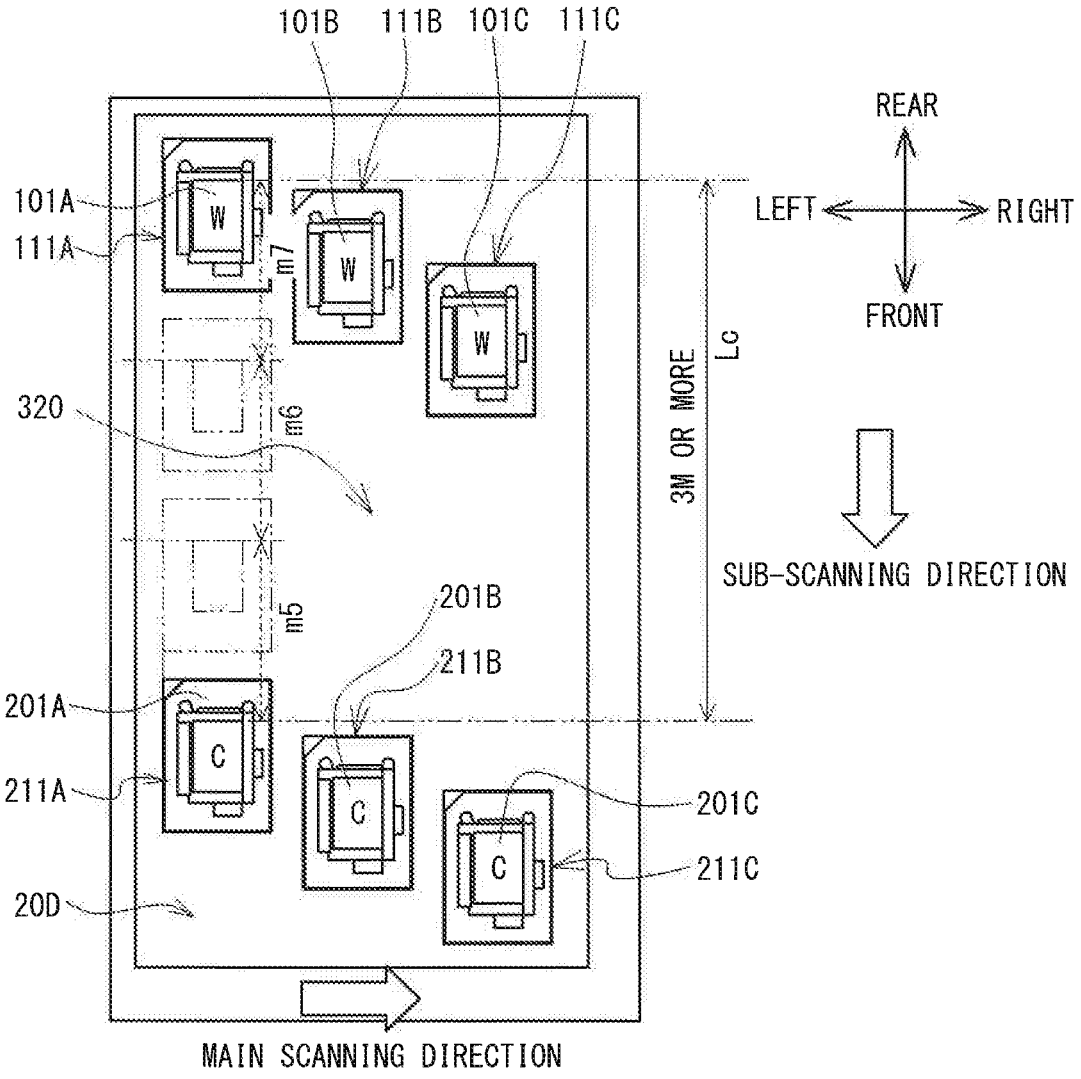
FIG. 9 is a plan view of a carriage 20D.

In FIGS. 9, m5 to m7 are distances of separation estimated in the same manner as in FIG. 5 when two virtual heads (shown by dotted lines) corresponding to the additional heads 300 are virtually disposed between the head 101A and the head 201A so as to be arranged in a row in the sub-scanning direction. It is defined that Lc=m5+m6+m7. In FIG. 9, M indicates the bleeding inhibition distance of the head 101A or the head 201A with respect to the two virtual heads corresponding to the additional heads 300. M is calculated using the same mathematical expression as that used to calculate L to be described later. Magnitude correlations between Lc, m5, m6, m7 and M are m5≥M, m6≥M, m7≥M, and Lc=m5+m6+m7≥3M. Therefore, as shown in FIG. 9, even if the two virtual heads corresponding to the additional heads 300 are aligned in the sub-scanning direction and disposed between the head 101A and the head 201A, the bleeding relating to the ink of the virtual heads corresponding to the additional heads 300 is inhibited.

The head attachment portion 111B and the head attachment portion 211B are provided from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. A head attachment portion 111C and a head attachment portion 211C are provided on the carriage 20D from the rear side toward the front side, to the right of the head attachment portion 111B and the head attachment portion 211B. The additional head attachment portion is not provided between the head attachment portion 111C and the head attachment portion 211C. The head attachment portion 111C is provided so as to be displaced forward from the head attachment portion 111B by a predetermined length. The head attachment portion 211C is also provided so as to be displaced forward from the head attachment portion 211B by a predetermined length. Structures of the head attachment portions 111B and 111C and of the head attachment portions 211B and 211C are respectively the same as those of the head attachment portion 111A and the head attachment portion 211A. Examples of the first heads that are attached to the head attachment portions 111A to 111C are the white ink head 101A to a white ink head 101C. Examples of the second heads that are attached to the head attachment portions 211A to 211C are the color printing head 201A to a color printing head 201C.

Structure of Carriage 20E

Figure 10:
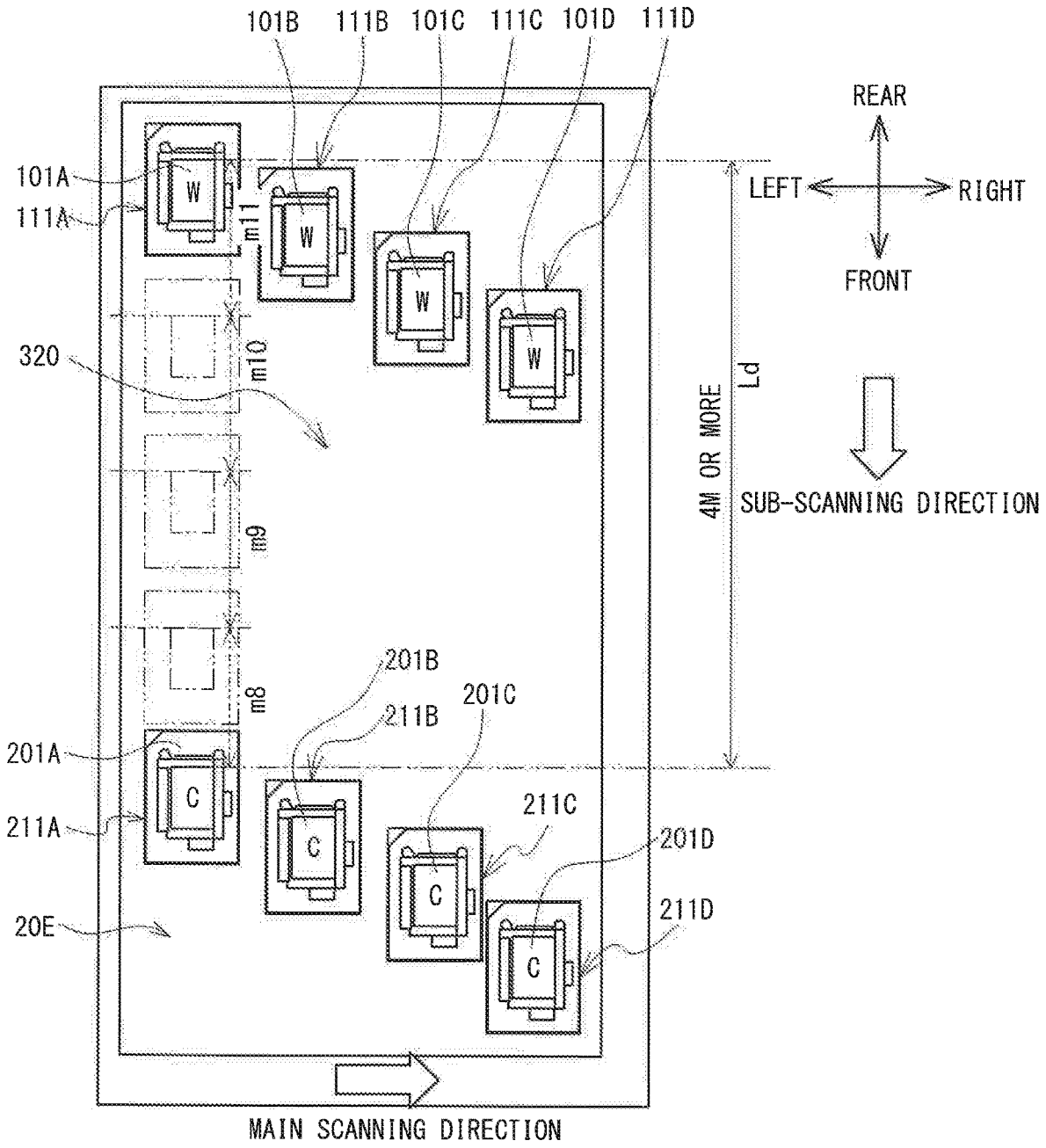
FIG. 10 is a plan view of a carriage 20E.

The carriage 20E, which is a fifth working example of the carriage 20, will be explained with reference to FIG. 10. The carriage 20E is a rectangle that is long in the front-rear direction. As shown in FIG. 10, the head attachment portion 111A is provided on the leftmost side of and on the rear side of the carriage 20E. An example of the first head that is attached to the head attachment portion 111A is the white ink head 101A. The opening (not shown in the drawings) to downwardly expose the nozzle surface (not shown in the drawings) provided on the lower surface of the first head, and the screw hole (not shown in the drawings) to fix the first head are provided in the head attachment portion 111A. The head attachment portion 211A is provided on the front side of the carriage 20E. An example of the second head that is attached to the head attachment portion 211A is the color printing head 201A. The opening (not shown in the drawings) to downwardly expose the nozzle surface (not shown in the drawings) provided on the lower surface of the second head, and the screw hole (not shown in the drawings) to fix the second head are provided in the head attachment portion 211A. The first head and the second head are disposed so as to be separated from each other in the sub-scanning direction that is orthogonal to the main scanning direction. The additional head attachment portion is not provided between the head attachment portion 111A and the head attachment portion 211A.

In FIG. 10, m8 to m11 are distances estimated in the same manner as in FIG. 5 when three virtual heads (shown by dotted lines) corresponding to the additional heads 300 are virtually disposed between the head 101A and the head 201A so as to be arranged in a row in the sub-scanning direction. It is defined that Ld=m8+m9+m10+m11. In FIG. 10, it is assumed that the three virtual heads corresponding to the additional heads 300, the head 101A and the head 201A are arranged in a straight line in the sub-scanning direction and that the nozzle arrays thereof are also arranged in a straight line in the sub-scanning direction. In FIG. 10, M indicates the bleeding inhibition distance of the head 101A or the head 201A with respect to the virtual heads corresponding to the additional heads 300. M is calculated using the same mathematical expression as that used to calculate L to be described later. Magnitude correlations between Ld, m8 to m11, and M are m8≥M, m9≥M, m10≥M, m11≥M and Ld=m8+m9+m10+m11≥4M. Therefore, as shown in FIG. 10, even if the three virtual heads corresponding to the additional heads 300 are disposed between the head 101A and the head 201A so as to be arranged in a row in the sub-scanning direction, the bleeding relating to the ink of the virtual heads corresponding to the additional heads 300 is inhibited.

The head attachment portion 111B and the head attachment portion 211B are provided from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. The head attachment portion 111C and the head attachment portion 211C are provided on the carriage 20E from the rear side toward the front side, to the right of the head attachment portion 111B and the head attachment portion 211B. The additional head attachment portion is not provided between the head attachment portion 111C and the head attachment portion 211C. The head attachment portion 111C is provided so as to be displaced forward from the head attachment portion 111B by a predetermined length. The head attachment portion 211C is also provided so as to be displaced forward from the head attachment portion 211B by a predetermined length.

A head attachment portion 111D and a head attachment portion 211D are provided from the rear side toward the front side, to the right of the head attachment portion 111C and the head attachment portion 211C. The additional head attachment portion is not provided between the head attachment portion 111D and the head attachment portion 211D. The head attachment portion 111D is provided so as to be displaced forward from the head attachment portion 111C by a predetermined length. The head attachment portion 211D is also provided so as to be displaced forward from the head attachment portion 211C by a predetermined length. The head attachment portions 111B, 111C and 111D, and the head attachment portions 211B, 211C and 211D respectively have the same structures as those of the head attachment portion 111A and the head attachment portion 211A. Examples of the first heads that are attached to the head attachment portions 111A to 111D are the white ink head 101A to a white ink head 101D. Further, examples of the second heads that are attached to the head attachment portions 211A to 211D are the color printing head 201A to a color printing head 201D.

Structure of Maintenance Unit 145A

Figure 11:
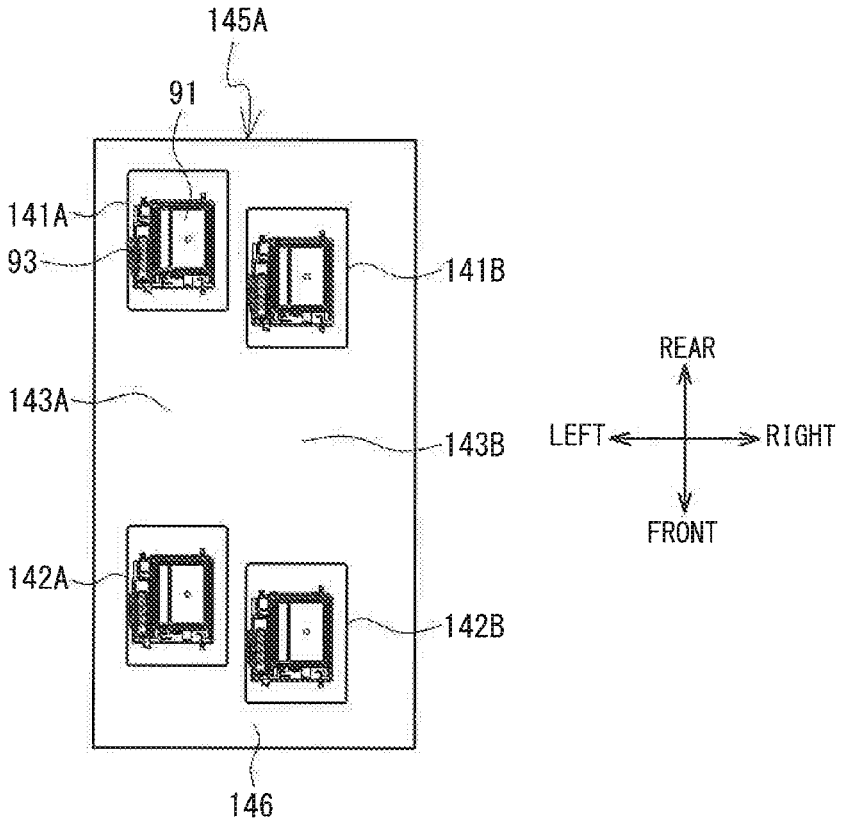
FIG. 11 is a plan view of a maintenance unit 145A.

The maintenance unit 145A, which corresponds to the carriage 20B of the second working example of the carriage 20, will be explained with reference to FIG. 11. The maintenance unit 145A is a unit that corresponds to the carriage 20B shown in FIG. 6. The maintenance unit 145A is provided in the non-printing area 140 shown in FIG. 3. The maintenance unit 145A includes a maintenance portion 141A and a maintenance portion 142A that are arranged on a base 146 having a rectangular shape in a plan view. The maintenance portion 141A is provided on the left side and on the rear side of the base 146, and the maintenance portion 142A is provided on the left side and on the front side of the base 146. An open space 143A is provided between the maintenance portion 141A and the maintenance portion 142A. Maintenance portions 141B and 142B are provided to the right of the maintenance portions 141A and 142A. An open space 143B is provided between the maintenance portion 141B and the maintenance portion 142B. The maintenance portions 141B and 142B are respectively provided so as to be displaced forward from the maintenance portions 141A and 142A by a predetermined length. The maintenance portions 141A, 142A, 141B and 142B each have the same structure as that of the maintenance portion 141 shown in FIG. 3.

Structure of Maintenance Unit 145B

Figure 12:
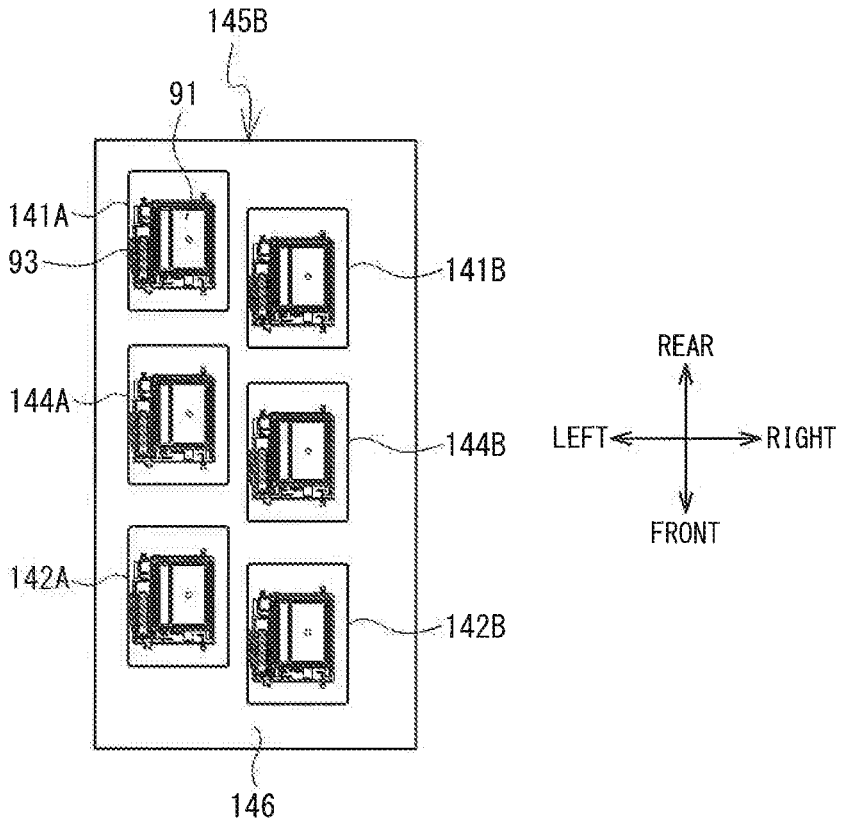
FIG. 12 is a plan view of a maintenance unit 145B.

The maintenance unit 145B, which corresponds to the carriage 20B of the second working example of the carriage 20, will be explained with reference to FIG. 12. The maintenance unit 145B is a unit that corresponds to the carriage 20B shown in FIG. 7. The maintenance unit 145B is provided in the non-printing area 140 shown in FIG. 3. The maintenance unit 145B includes the maintenance portion 141A, a maintenance portion 144A and the maintenance portion 142A that are provided from the rear side toward the front side, on the left side of the base 146 having a rectangular shape in a plan view. The maintenance portion 141B, a maintenance portion 144B and the maintenance portion 142B are provided to the right of the maintenance portions 141A, 144A and 142A, from the rear side toward the front side. The maintenance portions 141B, 144B and 142B are respectively provided so as to be displaced forward from the maintenance portions 141A, 144A and 142A by a predetermined length. The maintenance portions 141A, 144A, 142A, 141B, 144B and 142B each have the same structure as that of the maintenance portion 141 shown in FIG. 3. Since the number of the heads is increased, the maintenance portions 144A and 144B are additionally provided in the open space 143 shown in FIG. 3.

Structure of Ink Flow Path 70A

Figure 13:
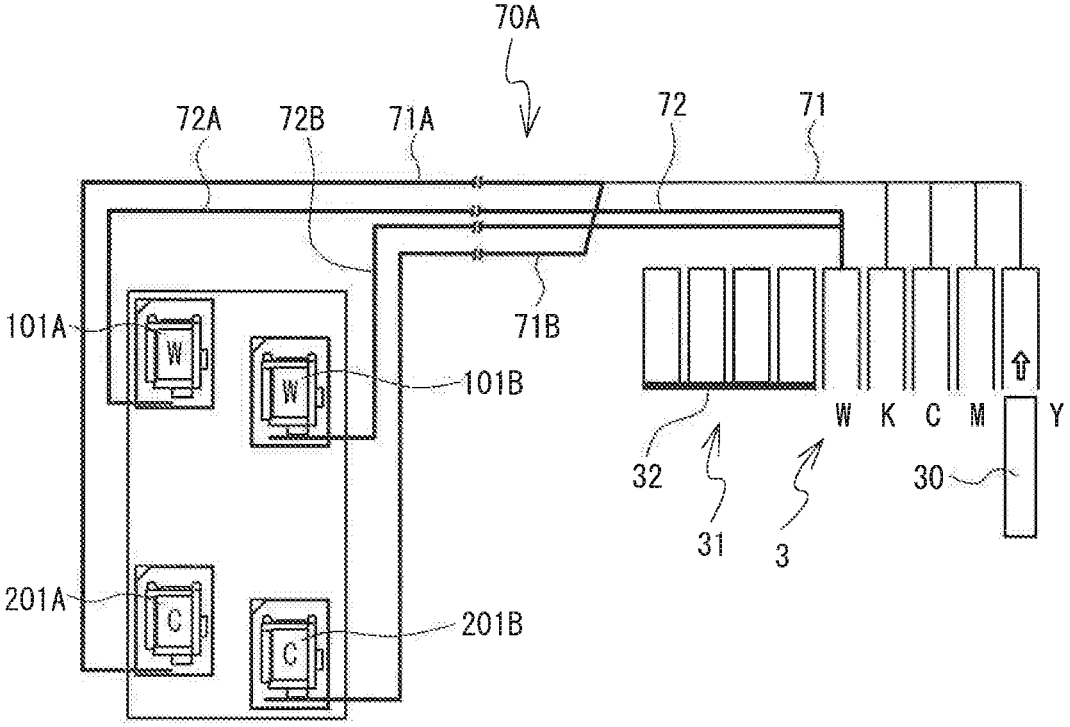
FIG. 13 is a diagram of an ink flow path 70A.

The structure of the ink flow path 70A that supplies the ink from the cartridges 30 to the heads will be explained with reference to FIG. 13. The ink flow path 70A is a flow path that corresponds to the carriage 20B shown in FIG. 6. The cartridges 30 for Y, M, C, K and W are mounted in the mounting portion 3. A storage portion 31, which is an unused section of the mounting portion 3, is provided with a lid 32. One end portion of a tube 71 is connected to each of the cartridges 30 for Y, M, C and K. In FIG. 13, the tube 71 is illustrated such that tubes for each color of Y, M, C and K are bundled together. The tube 71 branches into tubes 71A and 71B partway along the tube 71. The other end portion of the tube 71A is connected to the color printing head 201A, and the other end portion of the tube 71B is connected to the color printing head 201B. One end portion of a tube 72 is connected to the cartridge 30 for W. The tube 72 branches into tubes 72A and 72B partway along the tube 72. The other end portion of the tube 72A is connected to the white ink head 101A, and the other end portion of the tube 72B is connected to the white ink head 101B.

Structure of Ink Flow Path 70B

Figure 14:
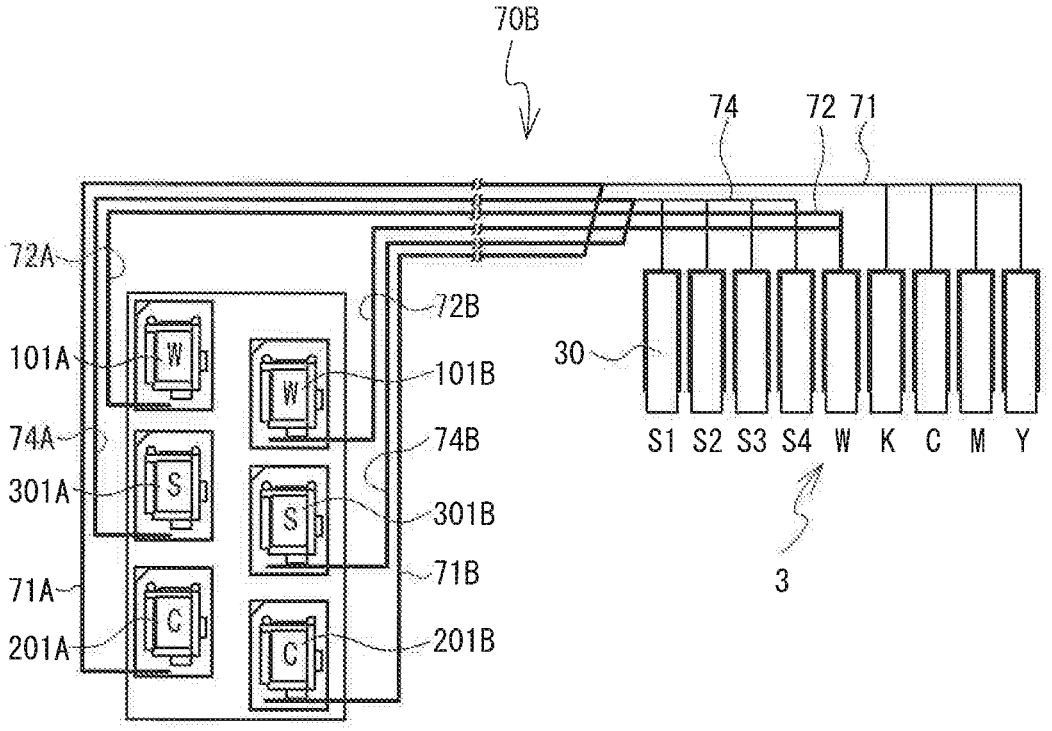
FIG. 14 is a diagram of an ink flow path 70B.

The structure of the ink flow path 70B will be explained with reference to FIG. 14. The ink flow path 70B is a flow path that corresponds to the carriage 20B shown in FIG. 7. The cartridges 30 (not shown in the drawings) for Y, M, C, K and W, and the cartridges 30 (not shown in the drawings) for special inks S1, S2, S3 and S4 are mounted in the mounting portion 3. The special inks S1, S2, S3 and S4 may be the same color or different colors. The tubes 71 and 72 are the same as those of the ink flow path 70A. One end portion of a tube 74 is connected to each of the cartridges 30 (not shown in the drawings) for the special inks S1 to S4. In FIG. 14, the tube 74 is illustrated such that tubes for the special inks S1 to S4 are bundled together. The tube 74 branches into tubes 74A and 74B partway along the tube 74. The other end portion of the tube 74A is connected to the special ink head 301A, and the other end portion of the tube 74B is connected to the special ink head 301B. The tube 74 is configured to correspond to the special inks S1 to S4 and the four cartridges 30. With respect to the tube 74, one to a maximum of four of the cartridges 30 for the special inks S1 to S4 may be selectively used corresponding to print content or color of the special inks S1 to S4. A plurality of the cartridges 30 for the special inks S1 to S4 of the same color may be mounted, and the special inks S1 to S4 may be supplied from the plurality of cartridges 30 to a single one of the special ink heads 301A and 301B, simultaneously or in a switching manner. In this case, flow paths for the special inks S1 to S4 of the unused tube 74 are provided with check valves (not shown in the drawings) so as not to affect the tube 74 that is being used.

Structure of Ink Flow Path 70C

In FIG. 14, the tube 74 of the ink flow path 70B is connected to the cartridges 30 for the special inks S1 to S4 and to the special ink heads 301A and 301B. However, the tube 74 may be connected to the cartridge 30 (not shown in the drawings) for the discharge printing ink (D) and to the discharge printing ink heads 302A and 302B.

Distance L Between Leading Nozzles that Does Not Cause Bleeding

Hereinafter, the distance L between the leading nozzles that does not cause bleeding will be explained with reference to FIG. 5. Tpw is a time period required until the leading nozzles on the rear end side of the second head (the color printing head 200 (C)) print a section that has been printed by the leading nozzles (not shown in the drawings) on the rear end side of the first head (the base printing head 100 (W)) of the carriage 20A that is the first working example shown in FIG. 5. During the time period required until the leading nozzles on the rear end side of the second head print the section that has been printed by the leading nozzles on the rear end side of the first head, the feeding of the platen 5 in the front-rear direction is repeated by a distance from the rear end side of the first head to the rear end side of the second head, while inserting a wait time after the movement in the main scanning direction. Accordingly, the following terms are defined.

L: Distance between leading nozzles, namely, the distance between the leading nozzles (not shown in the drawings) on the rear end side of the first head (the base printing head 100 (W)) and the leading nozzles on the rear end side of the second head (the color printing head 200 (C))

Tpw: Time period required until the leading nozzles of the second head print the section that has been printed by the leading nozzles of the first head Tcr: Total time of main scanning Tw: Wait time Cw: Platen feed number Ln: Nozzle array length in sub-scanning direction In: Interlace number In this case, the time period Tpw can be expressed as follows.

Tpw=(Total time of main scanning (Tcr)+Wait time (Tw))×(Distance (L) between leading nozzles/Nozzle length (Ln))×Interlace number (In)

Accordingly, Tpw=(Tcr+Tw)×Cw=(Tcr+Tw)×(L/Ln)×In, and the distance L can be expressed as follows.

$$L=(Tpw\times Ln)/((Tcr+Tw)\times In) \quad \text{Expression 1}$$

When the time period that does not cause the bleeding is calculated in advance on the basis of changes over time after the ejection of the ink, and the calculated time period is applied to Tpw, it is desirable that the distance L that does not cause the bleeding be:

$$L\geq(Tpw\times Ln)/((Tcr+Tw)\times In) \quad \text{Expression 2}$$

For example, if it can be seen that the ink dries up during 20 seconds on the basis of the changes over time after the ejection of the ink, it is sufficient that 20 seconds be substituted into Tpw in Expression 2 and the distance between the leading nozzles be set to a distance equal to or greater than the calculated distance L. The distance equal to or greater than the distance L is the bleeding inhibition distance M.

Ink Amount Setting Processing

Figure 15:
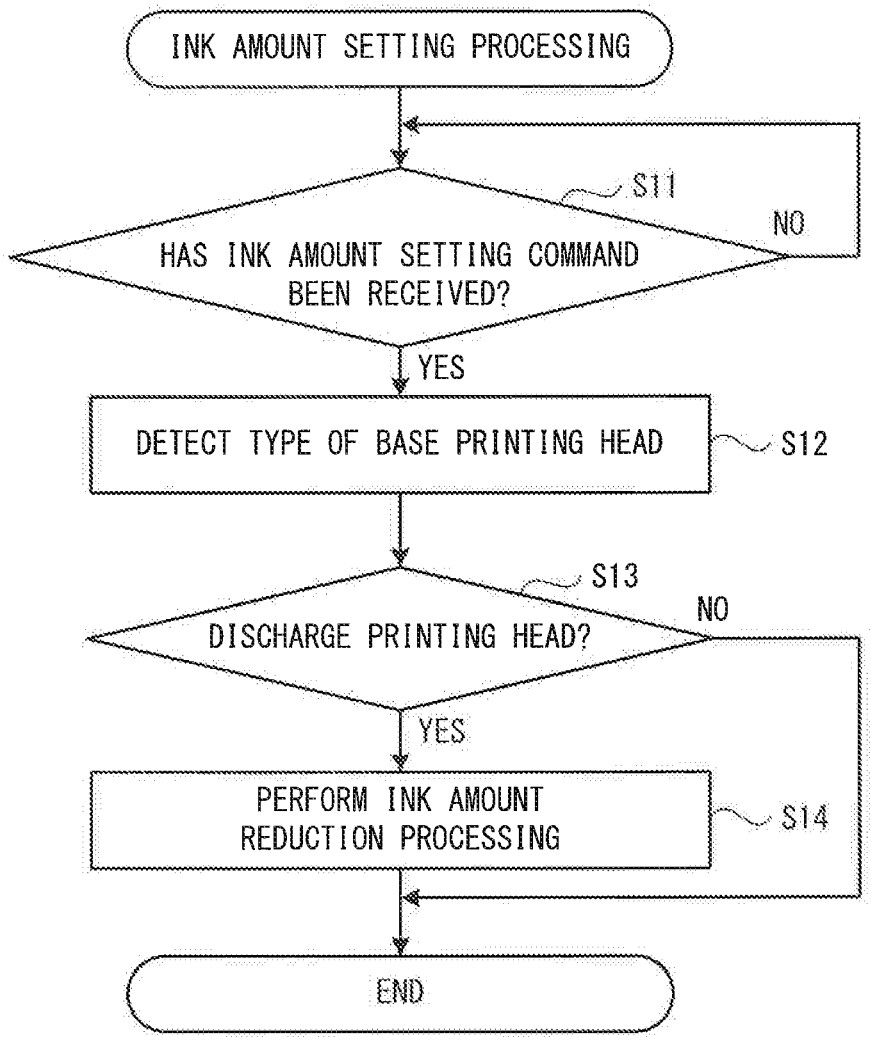
FIG. 15 is a flowchart of ink amount setting processing.

Ink amount setting processing will be explained with reference to FIG. 15. The CPU 40 is connected to the operation portion 47 or to the printer 1. Therefore, when a command to set the ink amount is received from a terminal device, such as a PC (yes at step S11), the CPU 40 detects the type of the additional head (step S12). When the CPU 40 determines that the command to set the ink amount has not been received (no at step S11), the CPU 40 returns the processing to step S11. The CPU 40 detects the type of the additional head 300 attached to the additional head attachment portion 310 detected by the head sensor 34 (step S12). When the CPU 40 detects the discharge printing ink head 302 (yes at step S13), the CPU 40 performs ink amount reduction processing (step S14). In the ink amount reduction processing, the CPU 40 stores, in the RAM 42, a flag that reduces the ink amount used in the white ink printing or the color printing, in comparison to when the additional head is not the discharge printing ink head 302. In the ink amount reduction processing (step S14), the CPU 40 causes the ejection amount of the ink used in the white ink printing or the color printing to be reduced by a predetermined amount, in comparison to when the discharge printing ink head 302 is not attached to the additional head attachment portion 310. When the discharge printing ink head 302 is not detected (no at step S13), the CPU 40 ends the ink amount setting processing.

Head Setting Processing

Figure 16:
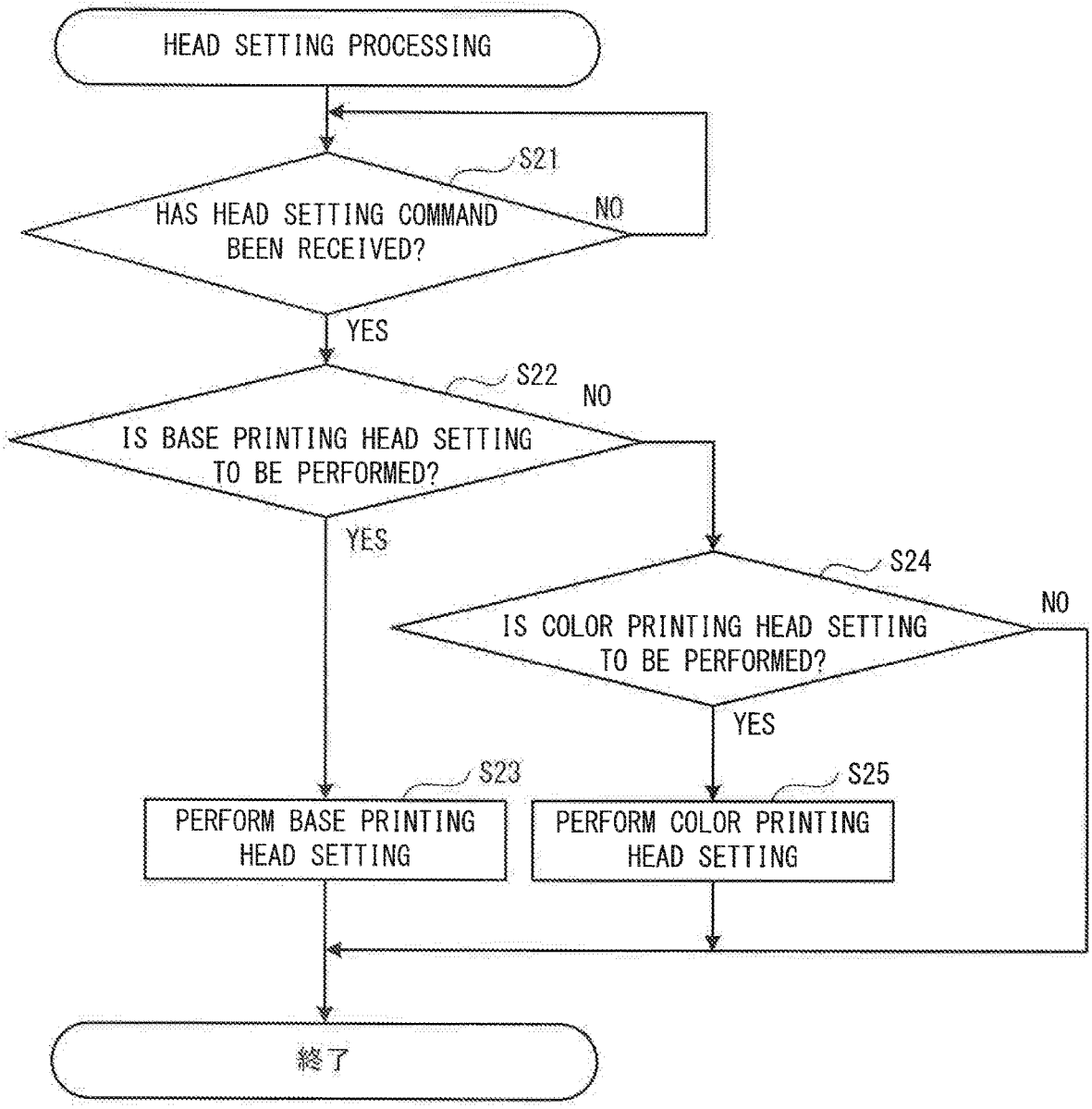
FIG. 16 is a flowchart of head setting processing.

Head setting processing will be explained with reference to FIG. 16. For example, when the two white ink heads 101A and 101B and the two color printing heads 201A and 201B are attached as shown in FIG. 8, or when the two discharge printing ink heads 302A and 302B and the two color printing heads 201A and 201B are attached, the head setting processing is processing to set whether to eject the ink from both the two heads of the same type or whether to use one of the two heads of the same type, in the same scan of the carriage 20C. More specifically, in the former case, the CPU 40 sets whether or not to eject the ink from both the heads 101A and 101B in the same scan of the carriage 20C, and whether or not to eject the ink from both the heads 201A and 201B in the same scan of the carriage 20C. Further, in the latter case, the CPU 40 sets whether or not to eject the ink from both the heads 302A and 302B in the same scan of the carriage 20C, and whether or not to eject the ink from both the heads 201A and 201B in the same scan of the carriage 20C.

When a command for the head setting processing is received from the operation portion 47 or from a terminal device, such as a PC, that is connected to the printer 1 (yes at step S1), the CPU 40 determines whether a base printing head setting command has been received (step S22). When the CPU 40 determines that the base printing head setting command has been received (yes at step S2), the CPU 40 causes a screen, which is used to select whether to use a plurality of the base printing heads or to use the single base printing head, to be displayed on the display 49 of the operation portion 47 or on the terminal device, such as the PC (step S23). When the user selects to use the plurality of base printing heads, the CPU 40 stores, in the RAM 42, a flag indicating that the plurality of base printing heads are to be used (step S23). On the other hand, when the user selects to use the single base printing head, the CPU 40 stores, in the RAM 42, a flag indicating that the single base printing head is to be used (step S23).

When the CPU 40 determines that the base printing head setting command has not been received (no at step S22) and determines that a color printing head setting command has been received (yes at step S24), the CPU 40 causes a screen, which is used to select whether to use a plurality of the color printing heads or to use the single color printing head, to be displayed on the display 49 of the operation portion 47 or on the terminal device, such as the PC (step S25). When the user selects to use the plurality of color printing heads, the CPU 40 stores, in the RAM 42, a flag indicating that the plurality of color printing heads are to be used (step S25). On the other hand, when the user selects to use the single color printing head, the CPU 40 stores, in the RAM 42, a flag indicating that the single color printing head is to be used (step S23). When the CPU 40 determines that the base printing head setting command has not been received (no at step S22) and also determines that the color printing head setting command has not been received (no at step S24), the CPU 40 ends the head setting processing.

Figure 17:
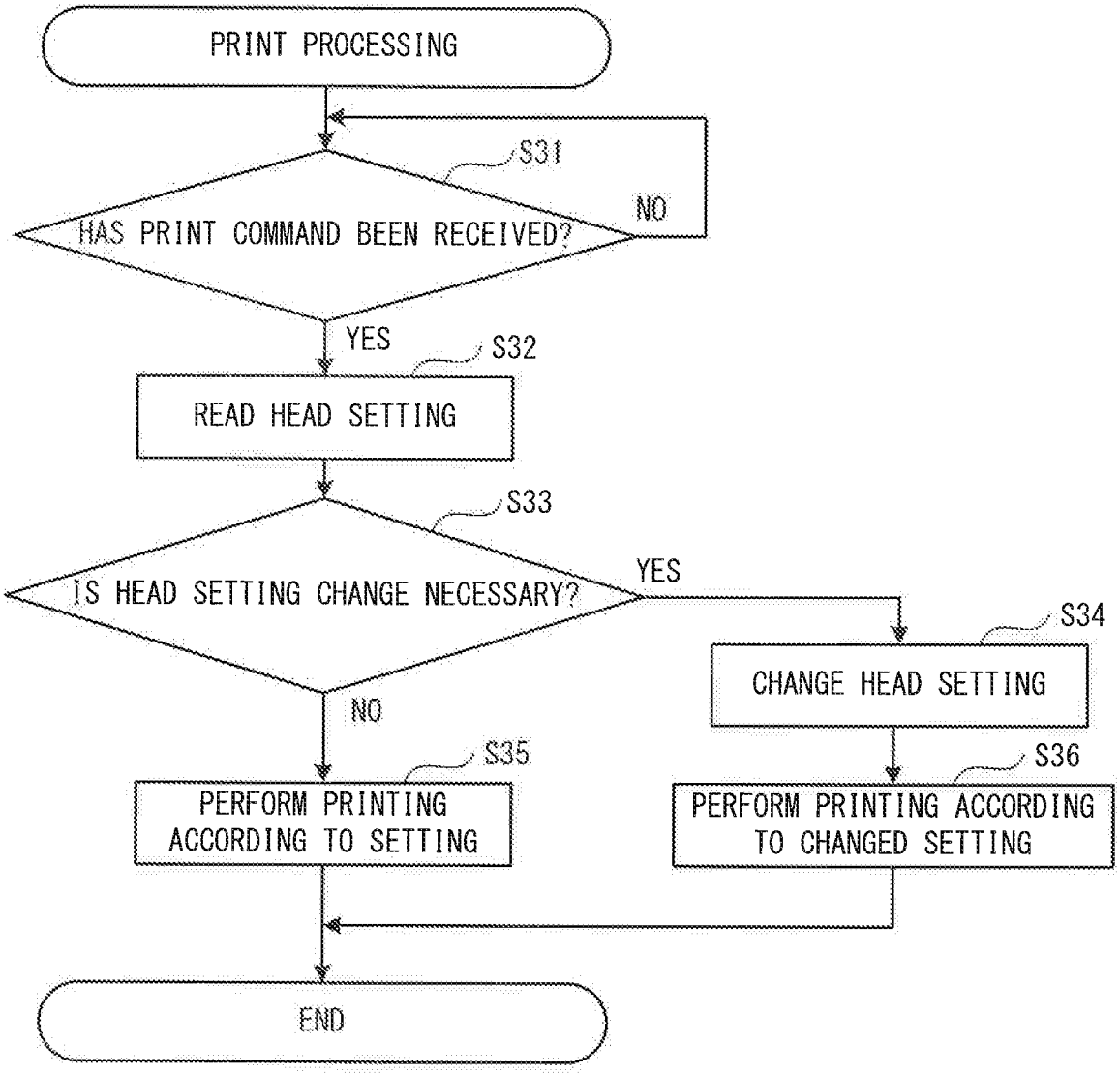
FIG. 17 is a flowchart of print processing.

Print processing will be explained with reference to FIG. 17. When a print processing command is received from the operation portion 47 or from the terminal device, such as the PC, that is connected to the printer 1 (yes at step S31), the CPU 40 reads the head setting (step S32). On the basis of the flag stored in the RAM 42 by the head setting processing, the CPU 40 reads the head setting relating to whether to use the two heads of the same type or to use one of the two heads of the same type. Next, the CPU 40 determines whether the head setting read at step S32 is to be changed (step S33). For example, even in the case of the setting to use the two heads of the same type, when it is determined that one of the heads has a failure (yes at step S33), the CPU 40 changes the head setting (step S34). Examples of the head failure include nozzle clogging and the like. When the CPU 40 determines that there is no need to change the head setting (no at step S33), the CPU 40 causes the printing to be performed according to the setting (step S35). When the head setting is changed (step S34), when the CPU 40 changes the head setting from the setting to use the two heads of the same type to the setting to use one of the heads, the printing is performed in accordance with the setting after the change (step S36).

Figure 19:
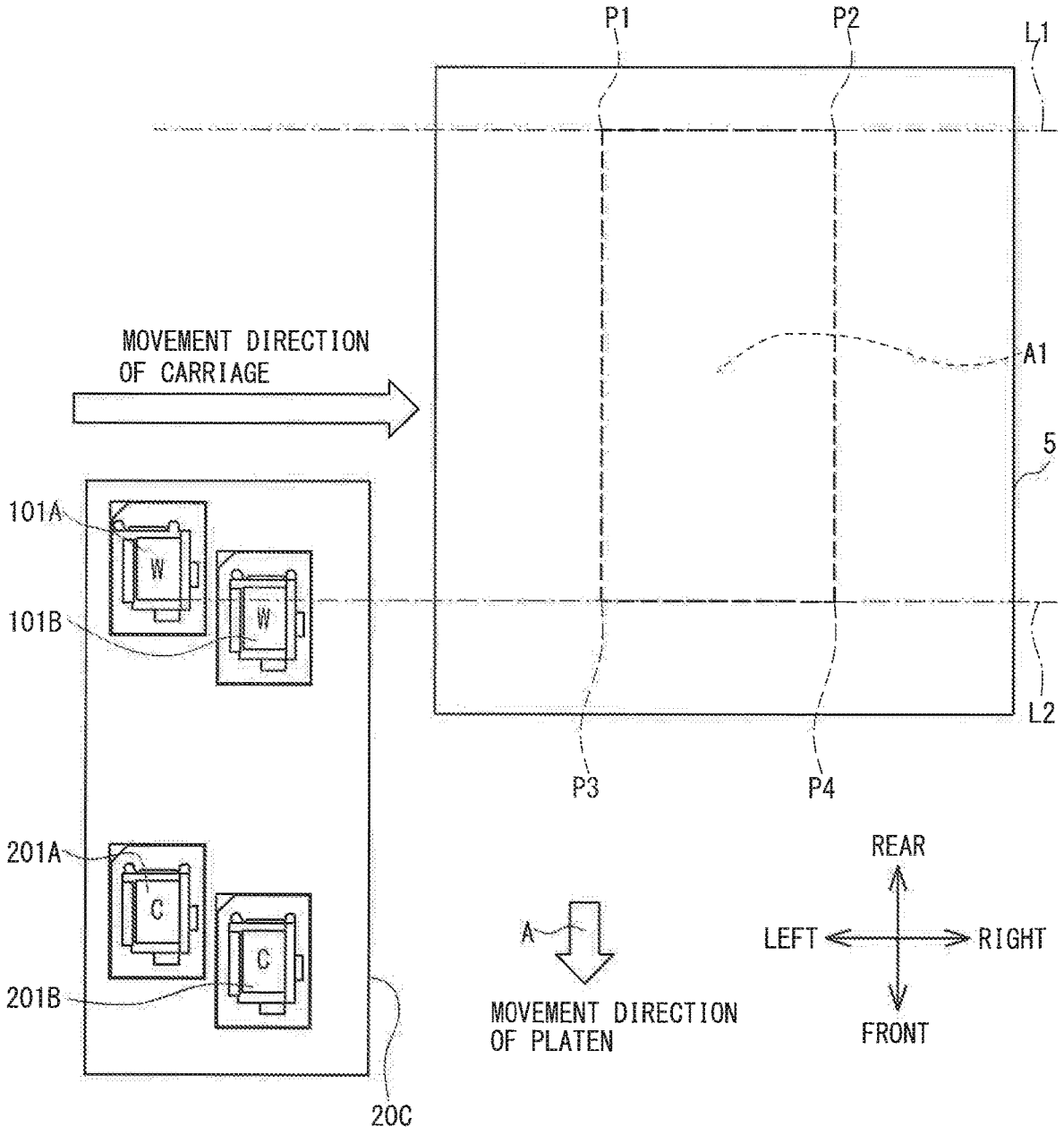
FIG. 19 is a diagram showing a positional relationship of a platen 5 and the carriage 20A that moves toward the platen 5 located at a base printing start position.

A first working example of the print processing by the carriage 20C, which is provided with the white ink heads 101A and 101B and the color printing heads 201A and 201B, will be explained with reference to FIG. 19. A rectangular area A1 surrounded by positions P1, P2, P3 and P4 shown in FIG. 19 is an area in which the baes printing is necessary. As shown in FIG. 19, the CPU 40 moves the platen 5 to a scanning position L2 including the position P3, which is a base printing start position of the head 101A. Then, the CPU 40 causes the carriage 20C to reciprocate in the left-right direction from the position P3 with respect to the area Al in which the base printing is necessary, and causes the white ink to be ejected from the nozzles 61 (refer to FIG. 18) of the head 101A, thus starting the base printing. The CPU 40 sequentially moves the platen 5 forward (in a direction of an arrow A) while causing the carriage 20C to reciprocate in the left-right direction. Thus, the CPU 40 causes the base printing of the white ink to be performed by the heads 101A and 101B, through bi-directional printing or uni-directional printing.

Next, when the carriage 20C moves to the right and the front end of the nozzle array 62 (refer to FIG. 18) of the head 201A faces the position P3, the CPU 40 starts the ejection of the color ink from the head 201A. Next, when the front end of the nozzle array 62 (refer to FIG. 18) of the head 201B faces the position P3, the CPU 40 starts the ejection of the color ink from the head 201B. Therefore, as shown in FIG. 19, in the same scan (the same main scan) of the print medium, the CPU 40 causes the respective heads to perform the printing together using the white ink for the base printing and the color ink.

Note that, in the above-described embodiment, if the ejection relating to the ink of the plurality of heads is simultaneous, the printing time is shorter than when the ejection is not simultaneous. The phrase "performs the printing together in the same scan" by the plurality of heads in the above-described embodiment is not referring to a case in which the plurality of heads eject the ink at the same time onto the same area. The area onto which the plurality of heads eject the ink is separate for each of the heads. "Performs the printing together in the same scan" refers to a case in which each of the heads ejects the ink onto respectively facing areas during the single scan (movement in the main scanning direction). In other words, a timing at which the plurality of heads eject the ink is preferably the same, but given restrictions of power supply and control, the timing may be shifted for each head Next, when the ejection of the white ink is complete up to the position P2 by the heads 101A and 101B, the CPU 40 ends the ejection of the white ink from the heads 101A and 101B. Further, when the ejection of the color ink is complete up to the position P2 by the heads 201A and 201B, the CPU 40 ends the ejection of the color ink from the heads 201A and 201B.

A second working example of the print processing by the carriage 20C, which is provided with the discharge printing ink heads 302A and 302B and the color printing heads 201A and 201B, will be explained with reference to FIG. 20. As shown in FIG. 20, the CPU 40 moves the platen 5 to a scanning position L1 including the position Pb, which is a discharge printing start position of the discharge printing ink head 302A. After that, the CPU 40 causes the carriage 20C to move to the right, and causes the discharge printing ink to be ejected from the nozzles 61 (refer to FIG. 18) of the head 302A onto the area A1 in which the discharge printing is necessary, thus starting the discharge printing. Therefore, the CPU 40 performs the discharge printing by moving the platen 5 from the front side to the rear side (in a direction of an arrow B). The CPU 40 sequentially moves the platen 5 rearward (in the direction of the arrow B) while causing the carriage 20C to reciprocate in the left-right direction, and thus causes the discharge printing to be performed by the heads 302A and 302B. When the ejection of the discharge printing ink is complete up to the position P4, the CPU 40 ends the ejection of the discharge printing ink from the heads 302A and 302B.

Next, the CPU 40 moves the platen 5 forward. Then, the carriage 20C moves, and the CPU 40 moves the platen 5 so that the front end of the nozzle arrays 62 (refer to FIG. 18) is aligned with the scanning position L2 including the position P3. Next, when the carriage 20C moves and the front end of the nozzle array 62 (refer to FIG. 18) faces the position P3, the CPU 40 starts the ejection of the color ink from the head 201A. Next, when the front end of the nozzle array 62 (refer to FIG. 18) of the head 201B faces the position P3, the CPU 40 starts the ejection of the color ink from the head 201B. Therefore, in the same scan (the same main scan) of the print medium, the CPU 40 causes both the head 201A and the head 201B to perform the printing together using the color ink, on the area Al in which the discharge printing has been performed by the ejection of the discharge printing ink. When the ejection of the color ink is complete up to the position P2, the CPU 40 ends the ejection of the color ink from the heads 201A and 201B. In order to remove the printed print medium, the CPU 40 moves the platen 5 to the front (in the direction of the arrow A). Further, the carriage 20C moves to the left and returns to a stand-by position.

Figure 21:
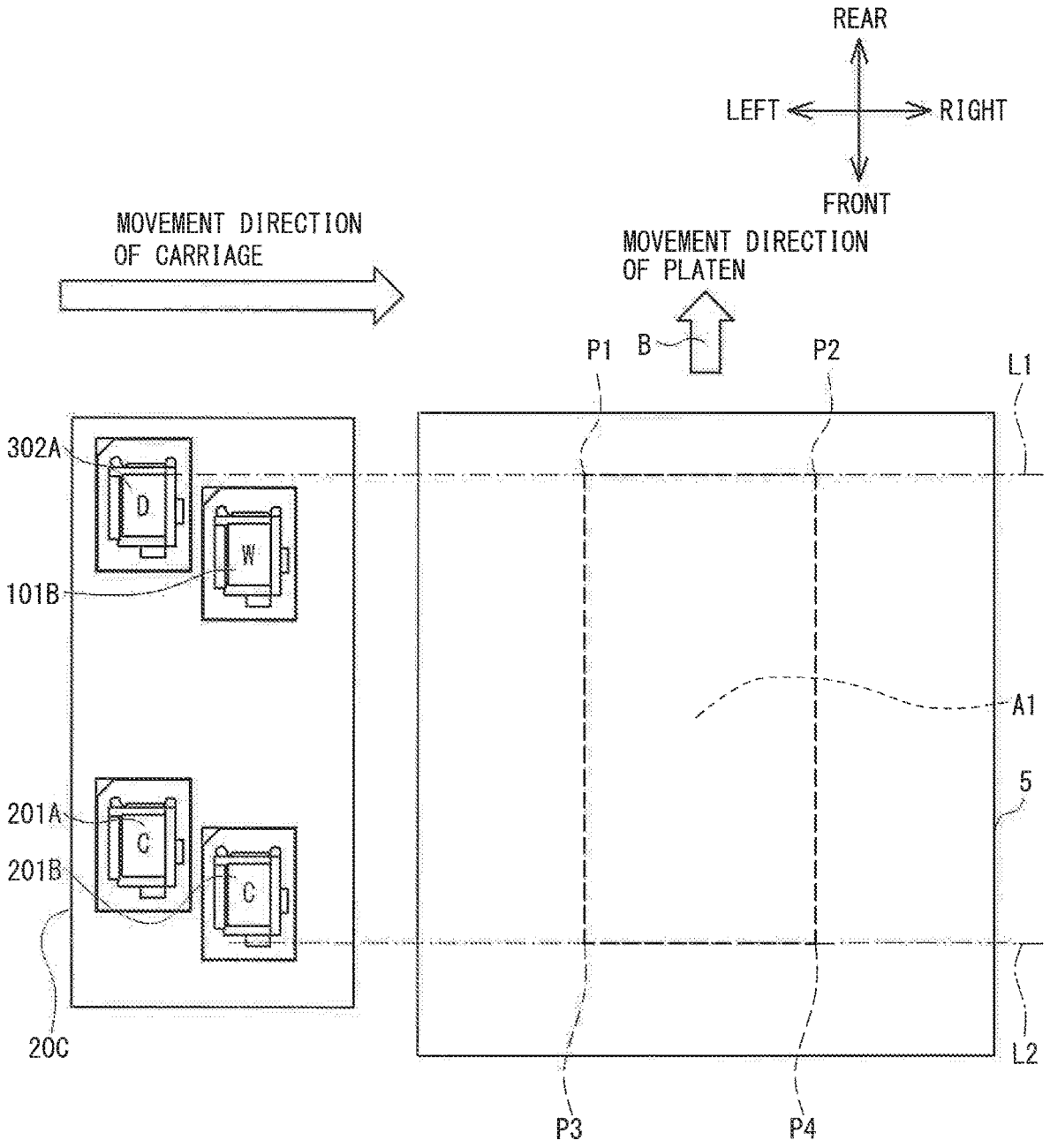
FIG. 21 is a diagram showing a positional relationship of the platen 5 and the carriage 20C that moves toward the platen 5 located at the discharge printing start position.

A third working example of the print processing by the carriage 20C, which is provided with the discharge printing ink head 302A, the white ink head 101B, and the color printing heads 201A and 201B, will be explained with reference to FIG. 21. As shown in FIG. 21, the CPU 40 moves the platen 5 to the scanning position L1 including the position P1, which is the discharge printing start position of the discharge printing ink head 302A. After that, the CPU 40 causes the carriage 20C to move to the right, and causes the discharge printing ink to be ejected from the nozzles 61 (refer to FIG. 18) of the head 302A onto the area Al in which the discharge printing is necessary, thus starting the discharge printing. Therefore, the CPU 40 performs the discharge printing by moving the platen 5 from the front side to the rear side (in the direction of the arrow B). The CPU 40 sequentially moves the platen 5 rearward (in the direction of the arrow B) while causing the carriage 20C to reciprocate in the left-right direction. Thus, the CPU 40 causes the discharge printing to be performed by the head 302A. When the ejection of the discharge printing ink is complete up to the position P4, the CPU 40 ends the ejection of the discharge printing ink from the head 302A.

Next, the CPU 40 moves the platen 5 forward. Then, the carriage 20C moves, and the CPU 40 moves the platen 5 so that the front end of the nozzle arrays 62 (refer to FIG. 18) is aligned with the scanning position L2 including the position P3. Next, when the carriage 20C moves and the front end of the nozzle array 62 (refer to FIG. 18) of the head 101B faces the position P3, the CPU 40 starts the ejection of the white ink from the head 101B. Next, when the ejection of the white ink is complete up to the position P2 by the head 101B, the CPU 40 ends the ejection of the white ink from the head 101B.

Next, when the front end of the nozzle array 62 (refer to FIG. 18) of the head 201A faces the position P3, the CPU 40 starts the ejection of the color ink from the head 201A. Next, when the front end of the nozzle array 62 (refer to FIG. 18) of the head 201B faces the position P3, the CPU 40 starts the ejection of the color ink from the head 201B. Therefore, in the same scan (the same main scan) of the print medium, the CPU 40 causes both the head 201A and the head 201B to perform the printing together using the color ink, on the area Al in which the discharge printing has been performed by the ejection of the discharge printing ink. When the ejection of the color ink is complete up to the position P2, the CPU 40 ends the ejection of the color ink from the heads 201A and 201B. In order to remove the printed print medium, the CPU 40 moves the platen 5 to the front (in the direction of the arrow A). Further, the carriage 20C moves to the left and returns to the stand-by position.

A fourth working example of the print processing by the carriage 20C, which is provided with the discharge printing ink head 302A, the white ink head 101B, and the color printing heads 201A and 201B, will be explained. In the fourth working example, a print operation using the discharge printing ink, the white ink and the color ink is performed by a one-way movement of the platen 5 that is conveyed from the rear side to the front side. The CPU 40 moves the platen 5 to the scanning position L2 including the position P3, which is the discharge printing start position of the discharge printing ink head 302A. After that, the CPU 40 causes the carriage 20C to move to the right, and causes the discharge printing ink to be ejected from the nozzles 61 (refer to FIG. 18) of the head 302A onto the area A1 in which the discharge printing is necessary, thus starting the discharge printing. Therefore, the CPU 40 performs the discharge printing by moving the platen 5 from the rear side to the front side. The CPU 40 sequentially moves the platen 5 forward while causing the carriage 20C to reciprocate in the left-right direction. Thus, the CPU 40 causes the discharge printing to be performed by the head 302A.

Next, the carriage 20C moves to the right, and the CPU 40 moves the platen 5 so that the front end of the nozzle arrays 62 (refer to FIG. 18) is aligned with the scanning position L2 including the position P3. Next, when the carriage 20C moves to the right and the front end of the nozzle array 62 (refer to FIG. 18) faces the position P3, the CPU 40 starts the ejection of the white ink from the head 101B. Next, when the ejection of the discharge printing ink is complete up to the position P4, the CPU 40 ends the ejection of the discharge printing ink from the head 302A. Further, when the ejection of the white ink is complete up to the position P2 by the head 101B, the CPU 40 ends the ejection of the white ink from the head 101B.

Next, when the front end of the nozzle array 62 (refer to FIG. 18) of the head 201A faces the position P3, the CPU 40 starts the ejection of the color ink from the head 201A. Next, when the front end of the nozzle array 62 (refer to FIG. 18) of the head 201B faces the position P3, the CPU 40 starts the ejection of the color ink from the head 201B. Therefore, in the same scan (the same main scan) of the print medium, the CPU 40 causes the respective heads to perform the printing together on the area A1 using the discharge printing ink, the white ink and the color ink. When the ejection of the color ink is complete up to the position P2, the CPU 40 ends the ejection of the color ink from the heads 201A and 201B. In order to remove the printed print medium, the CPU 40 moves the platen 5 to the front. Further, the carriage 20C moves to the left and returns to the waiting position.

Operations and Effects of Printer 1 of Embodiment

In the printer 1 of the above-described embodiment, the white ink heads 101A and 101B or the discharge printing ink heads 302A and 302B can be attached to the head attachment portion 111A, and the color printing heads 201A and 201B can be attached to the head attachment portions 211A and 211B. As shown in FIG. 8, on the carriage 20C that is transported in the main scanning direction by the main scanning drive portion 44, the heads 101A and 101B are disposed so as to be displaced from each other in the sub-scanning direction, and the heads 201A and 201B are disposed so as to be displaced from each other in the sub-scanning direction. Further, as shown in FIG. 20, on the carriage 20C, the heads 302A and 302B are disposed so as to be displaced from each other in the sub-scanning direction, and the heads 201A and 201B are disposed so as to be displaced from each other in the sub-scanning direction. Therefore, even when an ejection failure occurs in the nozzles of one of the heads 101A and 101B or one of the heads 302A and 302B, and even when an ejection failure occurs in the nozzles of one of the two heads 201A and 201B, the ink can be ejected from the nozzles of the other head that ejects the same type of ink in the main scanning. Therefore, even when the nozzle ejection failure occurs, it is possible to reduce a deterioration in print quality.

Further, the two heads 101A and 101B and the two heads 201A and 201B are mounted on the carriage 20C such that the distance by which the two heads 101A and 101B are displaced from each other in the sub-scanning direction is the same as the distance by which the two heads 201A and 201B are displaced from each other in the sub-scanning direction. Further, the two heads 302A and 302B and the two heads 201A and 201B are mounted on the carriage 20C such that the distance by which the two heads 302A and 302B are displaced from each other in the sub-scanning direction is the same as the distance by which the two heads 201A and 201B are displaced from each other in the sub-scanning direction. Therefore, some of the nozzles of the two heads that eject the same type of ink can overlap with each other in the same range in the sub-scanning direction. Even when an ejection failure occurs in the nozzles of one of the heads in the overlapping range, the ink can be ejected from the nozzles of the other head that ejects the same type of ink in the main scanning. Thus, even when the ejection failure occurs in the nozzles, it is possible to reduce the deterioration in print quality.

Further, as shown in FIG. 8, the two heads 101A and 101B and the two heads 201A and 201B are mounted on the carriage 20C such that the distance between the head 101A and the head 201A is the same as the distance between the head 101B and the head 201B in the sub-scanning direction. In addition, as shown in FIG. 20, the two heads 302A and 302B and the two heads 201A and 201B are mounted on the carriage 20C such that the distance between the head 302A and the head 201A is the same as the distance between the head 302B and the head 201B in the sub-scanning direction. Therefore, the time period required until the color ink is ejected from the head 201A onto the white ink ejected from the head 101A can be the same as the time period required until the color ink is ejected from the head 201B onto the white ink ejected from the head 101B. Further, the time period required until the color ink is ejected from the head 201A onto the discharge printing ink ejected from the head 302A can be the same as the time period required until the color ink is ejected from the head 201B onto the discharge printing ink ejected from the head 302B.

The two heads 101A and 101B and the two heads 201A and 201B are mounted on the carriage 20C such that the distance between the head 101A and the head 201A, and the distance between the head 101B and the head 201B in the sub-scanning direction are each longer than the length of each of the head 101A and the head 101B in the sub-scanning direction. This relationship also applies to the distance between the head 302A and the head 201A of the carriage 20C shown in FIG. 20, and the distance between the head 302B and the head 201B. Therefore, the time period required until the color ink is ejected from each of the heads 201A and 201B onto the white ink ejected from each of the heads 101A and 101B or onto the discharge printing ink ejected from each of the heads 302A and 302B becomes longer, and the possibility of bleeding of the color ink is reduced.

Further, the CPU 40 causes the white ink, which is a base ink, to be ejected from the heads 101A and 101B as a first liquid, or causes the discharge printing ink, which is the base ink, to be ejected from the heads 302A and 302B as the first liquid. The CPU 40 causes the color ink to be ejected from the heads 201A and 201B, as a second liquid, onto the area Al of the ejected base ink. Thus, the printing can be performed using the color ink on the area Al printed using the base ink, and it is possible to improve the print quality.

In the head setting processing, the CPU 40 performs setting as to at least one of: whether or not to eject the ink from both the two heads 101A and 101B or from both the two heads 302A and 302B in the same scan of the carriage 20C; and whether or not to eject the ink from both the two heads 201A and 201B in the same scan of the carriage 20C. Therefore, when there is a failure in one of the two heads of the same type, the CPU 40 can use the other head to perform the printing, and it is thus possible to reduce the deterioration in print quality.

Further, in the printer 1, the two heads 101A and 101B and the two heads 201A and 201B are mounted on the single carriage 20C. Further, the two heads 302A and 302B and the two heads 201A and 201B are mounted on the single carriage 20C. Thus, the two heads 101A and 101B and the two heads 201A and 201B, or the two heads 302A and 302B and the two heads 201A and 201B can eject the ink by the same scan of the single carriage 20C.

Further, in the printer 1, when the distance of separation L between the head 101A and the head 201A, the distance of separation L between the head 101B and the head 201B, the distance of separation L between the head 302A and the head 201A, or the distance of separation L between the head 302B and the head 201B satisfies the condition $L \geq (Tpw \times Ln)/((Tcr+Tw) \times In)$, there is no need to provide the wait time to inhibit the bleeding of the ink, between the ejection of the head 101A and the ejection of the head 201A, between the ejection of the head 101B and the ejection of the head 201B, between the ejection of the head 302A and the ejection of the head 201A, or between the ejection of the head 302B and the ejection of the head 201B, respectively. Thus, in comparison to when the wait time is provided to inhibit the bleeding of the ink, the printing time can be shortened.

Further, in the printer 1, the additional head attachment portion can be provided between the head 101A and the head 201A, between the head 101B and the head 201B, between the head 302A and the head 201A, or between the head 302B and the head 201B, respectively, in the sub-scanning direction. Therefore, the printer 1 can correspond to a variety of printing by selectively attaching, as the additional head, the head that ejects the discharge printing ink, the head that ejects the special ink, or the like to the additional head attachment portion. Further, when the additional head is not mounted, favorable printing can be speedily performed while securing a drying time with respect to the liquid ejected from the base printing head.

The printer 1 is an example of a "liquid ejection device" of the present disclosure. The white ink or the discharge printing ink is an example of a "first liquid" of the present disclosure. The color ink is an example of a "second liquid" of the present disclosure. The head 100, the heads 101A to 101D, or the heads 302A and 302B are an example of a "first head" of the present disclosure. The head 200, and the heads 201A to 201D are an example of a "second head" of the present disclosure. The additional head 300, the special ink head 301, and the special ink heads 301A and 301B are an example of an "additional head" of the present disclosure. Further, the main scanning drive portion 44 is an example of a "movement mechanism" of the present disclosure. The CPU 40 that performs the processing at step S23 of the head setting processing is an example of a "setting portion" of the present disclosure.

embodiment, and various modifications are possible. For example, in the ink amount setting processing, in place of the detection processing (step S12) of the type of the base printing head, a type of the head mounted on the printer 1 may be input by the user from the operation portion 47, and the CPU 40 may automatically set a reduction amount of the ink on the basis of the input result. Further, the CPU 40 may perform automatic analysis of print data for printing in the printer 1, and the CPU 40 may automatically set the reduction amount of the ink on the basis of the analysis result. An example of the automatic analysis is a case in which the CPU 40 analyzes that, with respect to a whole area on which the head attached to the head attachment portions 111A and 111B eject the ink, after the ejection of the liquid by the head, the liquid is ejected by another head other than the head. The CPU 40 may perform the automatic analysis on the basis of an ejection order of each of the heads and on overlap of printing positions. Further, in the printer 1, in accordance with the number and the type of the heads mounted on the carriage 20, drive control of a voltage, electric current, waveform, timing and the like to drive the carriage 20 may be changed as necessary. The changes to the drive control may be determined by an input operation by the user. In addition, the changes to the drive control may be automatically determined by automatically detecting the number and the type of the heads mounted on the carriage 20, or by automatically analyzing the number and the type of the heads from the image to be printed and processes.

In the above-described printing processes, when the carriage 20A moves from the left to the right, the printing is started with respect to the area Al, and thus, the start position of the discharge printing, the base printing, and the color printing (the position P1) is located on the left end side of the area Al. If the printing is started with respect to the area Al when the carriage 20A moves from the right to the left, the start position of the discharge printing, the base printing, and the color printing (the position P2) is located on the right end side of the area Al. All of the start positions of the discharge printing, the base printing, and the color printing are located on either the left end side or the right end side of the area Al, but the start position of any one of the discharge printing, the base printing, and the color printing may be located on the other side.

In the above-described printing processes, when the platen 5 moves from the rear to the front, when the printing is started with respect to the area Al on which the printing is required, the start position of the discharge printing, the base printing, and the color printing is located at the rear side of the area Al. If the printing is started with respect to the area Al when the platen 5 moves from the front to the rear, the start position of the discharge printing, the base printing, and the color printing may be located on the front side of the area Al. Further, the start positions of the discharge printing, the base printing, and the color printing are not limited to all being located on the rear side or the front side of the area Al, and the start position of any one of the discharge printing, the base printing, and the color printing may be located on the other side.

Further, a difficulty of drying the ink depends on an operating environment. Therefore, when it is wished to secure the time interval between each of the discharge printing, the base printing, and the color printing, rather than widening the gap between the head 100, the head 302, and the head 200, even if operating efficiency is lowered, the discharge printing, the base printing, and the color printing are performed in two reciprocal movements of the platen 5 in the front-rear direction. For example, as shown in FIG. 29C, in the printer 1, the discharge printing is performed when the platen 5 is conveyed from the rear side to the front side. Next, the base printing is performed when the platen 5 is conveyed from the front side to the rear side. Next, the color printing is performed when the platen 5 is conveyed from the front side to the rear side. In this case, it is possible to secure the drying time of the ink by widening each of intervals between the discharge printing, the base printing, and the color printing. Note that the discharge printing is performed when the platen 5 is conveyed from the rear to the front in order to visibly check whether a discharge printing section is obtained or not. The final color printing is performed when the platen 5 is conveyed from the rear side to the front side. Thus, the printed print medium can be immediately removed.

Further, one of the scanning position including the discharge printing start position P1 of the head 302, or the scanning position including the discharge printing complete position P4 of the head 302 may be aligned with the scanning position including the printing start position of the head 200 or the head 100. In this case, even if the head 200, the head 100, and the additional head 300 perform printing in exactly the same area, the printing start position of the head 200 or the head 100 need not necessarily be the discharge printing start position P1 by the discharge printing ink head 302. The end portion position P2 of the printing area on the opposite side of the scan, in the scan including the discharge printing start position P1 of the head 302, may be the printing start position of the head 200 or the head 100. The discharge printing complete position P4 of the additional head 300 may be the printing start position of the head 200 or the head 100. The end position P3 of the printing area on the opposite side of the scan, in the scan including the discharge printing complete position P4 of the head 302, may be the printing start position of the head 200 or the head 100. The discharge printing starts from the position P1, but the base printing may start from the position P2 and the color printing may start from the position P4. The start positions may be set while taking into account the print image, the drying time of the ink, and the like as necessary. The stand-by position of the carriage 20A is on the right side, but may be on the left side.

As shown in FIG. 19, and FIG. 20, in a case in which a plurality of heads of the same type are provided in the main scanning direction of the carriage 20B, and those heads of the same type are disposed in the sub-scanning direction so as to be displaced from each other by a predetermined length, of the heads of the same type, the determination as to which part of which of the heads is the printing start position is made in the following manner. In relation to the printing by the plurality of heads of the same type, the movement direction of the platen 5 in the sub-scanning direction (the direction of the arrow B in FIG. 20, and the direction of the arrow A in FIG. 19 and FIG. 28) is specified. In that movement direction, the side to which the platen 5 moves in accordance with a progression of the printing is referred to as a printing downstream side, and the opposite side is referred to as a printing upstream side. Of the plurality of heads of the same type, the head for which the end of the nozzle arrays on the printing downstream side of each of the heads is furthest to the printing upstream side is specified. Further, in relation to the specified head, the end on the printing downstream side of the nozzle arrays positioned furthest to the printing downstream side may be taken as a reference, and the printing start position may be determined. In FIG. 20, the printing downstream side is the rear side in the drawing, and of the two columns of the heads on the left and the right, the rear side of the discharge printing ink head 302B in the right column is the side that includes the printing start position. The printing downstream side in FIG. 19 is the front side in the drawings, and, of the two columns of the heads on the left and the right, the front side of one of the heads in the left column is the side that includes the printing start position. In FIG. 19, the front side of the white ink head 101A, and in FIG. 28, the front side of the color printing head 201A is the side that includes the printing start position.

Note that "different types of heads are attached to at least one of the two base printing head attachment portions or the two color printing head attachment portions" indicates the following cases, for example. A first case is a state in which, when the two base printing head attachment portions 110A and 110B are provided on the carriage 20C, the discharge printing ink head 302 is attached to one of the base printing head attachment portions 110A and 110B, and the white ink head 101A is attached to the other of the base printing head attachment portions 110A and 110B. A second case is a state in which, when the color printing head attachment portions 210A and 210B are provided on the carriage 20C, the color printing head 201A is attached to one of the color printing head attachment portions 210A and 210B, and the special ink head 301A is attached to the other of the color printing head attachment portions 210A and 210B.

In the present disclosure, the discharge printing ink is a chemical agent that generates an effect of decoloring an object to be printed, and does not impart color, through any kind of dye or pigment, to the color of the object to be printed. However, the discharge printing ink may be the chemical agent that generates the effect of decoloring the object to be printed, and may also have an effect of imparting color, through any kind of dye or pigment, to the color of the object to be printed. It is essential for the discharge printing ink to have the effect of decoloring the object to be printed, but it is not essential to have the effect of imparting color, through any kind of dye or pigment, to the color of the object to be printed. Note that, of the heads 100 and 101A to 101D, the heads 200 and 201A to 201D, and the additional heads 300, 301, 301A to 301B, 302, and 302A to 302B, any one of the heads may be the head that ejects the white ink, the head that ejects the color ink, the head that ejects the special ink, and the head that ejects the discharge printing ink.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid ejection device, comprising:

at least two first heads configured to eject a first liquid from nozzles;

at least two second heads configured to eject, from nozzles, a second liquid different from the first liquid; and a movement mechanism configured to transport, in a main scanning direction, a carriage on which the at least two first heads and the at least two second heads are mounted, one of the at least two first heads being displaced from another of the at least two first heads in a sub-scanning direction and one of the at least two second heads being displaced from another of the at least two second heads in the sub-scanning direction, the one of the at least two first heads and the one of the at least two second heads being mounted in line with each other in the sub-scanning direction and the another of the at least two first heads and the another of the at least two second heads being mounted in line with each other in the sub-scanning direction, further, the one of the at least two second head relative to the one of the at least two first heads, and the another of the at least two second heads relative to the another of the at least two first heads, being mounted on same side in the sub-scanning direction.

2. The liquid ejection device according to claim 1, wherein the at least two first heads and the at least two second heads are mounted on the carriage where a distance by which the at least two first heads are displaced from each other in the sub-scanning direction is the same as a distance by which the at least two second heads are displaced from each other in the sub-scanning direction.

3. The liquid ejection device according to claim 2, wherein the at least two first heads and the at least two second heads are mounted on the carriage where distances between each of the first heads and each of the second heads are the same as each other in the sub-scanning direction.

4. The liquid ejection device according to claim 3, wherein the at least two first heads and the at least two second heads are mounted on the carriage at the respective positions where the distance between each of the first heads and each of the second heads in the sub-scanning direction is longer than a length of the first head in the sub-scanning direction.

5. The liquid ejection device according to claim 1, wherein each of the first heads ejects base ink as the first liquid, the liquid ejection device further comprises a control portion configured to control the ejection from each of the first heads and the second heads, and the control portion causes the second liquid to be ejected from the at least two second heads onto an area of the base ink ejected by the at least two first heads.

6. The liquid ejection device according to claim 1, further comprising:

a setting portion configured to perform setting relating to at least one of whether to perform the ejection from both the at least two first heads in the same scan of the carriage and whether to perform the ejection from the at least two second heads in the same scan of the carriage.

7. The liquid ejection device according to claim 1, wherein when

L is a distance between the first head and the second head,

Tpw is a time period required until leading nozzles of the second head print a section printed by leading nozzles of the first head, Tcr is a total time of main scanning, Tw is a wait time, Ln is a length of a nozzle array in the sub-scanning direction, and In is an interlace number, then $L \geq (Tpw \times Ln)/((Tcr+Tw) \times In)$ is established.

8. The liquid ejection device according to claim 1, wherein the at least two first heads and the at least two second heads are mounted on the single carriage.

9. The liquid ejection device according to claim 1, wherein at least two additional head attachment portions are provided between each of the first heads and each of the second heads in the sub-scanning direction, and each additional head is configured to be additionally attached to the additional head attachment portions.

* * * * *